US008068962B2

(12) United States Patent
Colvard

(10) Patent No.: US 8,068,962 B2
(45) Date of Patent: Nov. 29, 2011

(54) 3D CONTROL SYSTEM FOR CONSTRUCTION MACHINES

(75) Inventor: John Charles Colvard, Wilkesboro, NC (US)

(73) Assignee: Power Curbers, Inc., Salisbury, NC (US)

( * ) Notice: Subject to any disclaimer, the term of this patent is extended or adjusted under 35 U.S.C. 154(b) by 766 days.

(21) Appl. No.: 12/098,429

(22) Filed: Apr. 5, 2008

(65) Prior Publication Data

US 2008/0253834 A1 Oct. 16, 2008

Related U.S. Application Data

(60) Provisional application No. 60/910,243, filed on Apr. 5, 2007, provisional application No. 60/910,247, filed on Apr. 5, 2007, provisional application No. 60/910,251, filed on Apr. 5, 2007.

(51) Int. Cl.
*E01C 19/00* (2006.01)
*E01C 19/48* (2006.01)
*E01C 19/52* (2006.01)

(52) U.S. Cl. ..... 701/50; 701/207; 701/213; 404/84.05

(58) Field of Classification Search ..... None
See application file for complete search history.

(56) References Cited

U.S. PATENT DOCUMENTS 3,763,567 A 10/1973 Hudis
4,185,712 A 1/1980 Bulger
4,197,032 A 4/1980 Miller
4,319,859 A 3/1982 Wise
4,526,493 A 7/1985 Hall et al.
4,726,682 A 2/1988 Harms et al.
4,789,266 A 12/1988 Clarke, Jr. et al.
4,808,026 A 2/1989 Clarke, Jr. et al.
4,943,199 A 7/1990 Zamiko et al.
4,961,173 A 10/1990 Sehr et al.
4,988,233 A 1/1991 Kasler et al.
5,035,290 A 7/1991 Harms et al.
5,035,384 A 7/1991 Werthmann (Continued)

FOREIGN PATENT DOCUMENTS

DE 19951297 C1 * 4/2001

(Continued)

OTHER PUBLICATIONS

"International Search Report" and "Written Opinion" of the International Search Authority (Korean Intellectual Property Office) in Power Curbers, Inc. et al. mailed on Jul. 7, 2008 and completed on Jul. 7, 2008, for International Patent Application Serial No. PCT/US2008/059516 filed on Apr. 5, 2008, 11 pages.

(Continued)

*Primary Examiner* — Michael J. Zanelli
(74) *Attorney, Agent, or Firm* — Tillman Wright, PLLC; James D. Wright; Chad D. Tillman

(57) ABSTRACT

A construction system utilizing 3D control includes a fixed base station of known location; a self-propelled construction machine located in the general vicinity of the fixed base station; and a rotating mobile unit assembly mounted on the self-propelled construction machine and having a location-determination device arranged to rotate around an axis. The location-determination device is adapted to operate in conjunction with the fixed base station to determine geodetic information about the self-propelled construction machine.

17 Claims, 14 Drawing Sheets

U.S. PATENT DOCUMENTS 5,046,888 A 9/1991 King
5,051,025 A 9/1991 Taylor, Jr.
5,059,062 A 10/1991 Bresnahan
5,061,115 A 10/1991 Godbersen et al.
5,062,737 A 11/1991 Samuels
5,101,360 A 3/1992 Bennett
5,173,309 A 12/1992 Belarde
5,190,397 A 3/1993 Bengford et al.
5,209,602 A 5/1993 Godbersen
5,258,961 A 11/1993 Sehr et al.
D344,942 S 3/1994 Gilman et al.
5,309,407 A 5/1994 Sehr et al.
5,318,377 A 6/1994 Swisher, Jr. et al.
5,352,063 A 10/1994 Allen et al.
5,405,212 A 4/1995 Swisher, Jr. et al.
5,477,459 A * 12/1995 Clegg et al. ..... 701/300
5,492,432 A 2/1996 Eben et al.
5,533,888 A 7/1996 Belarde
5,549,412 A 8/1996 Malone
5,553,407 A 9/1996 Stump
5,588,776 A 12/1996 Swisher, Jr. et al.
5,616,291 A 4/1997 Belarde
5,659,985 A 8/1997 Stump
5,662,431 A 9/1997 Colvard
D386,152 S 11/1997 Warneke
5,704,142 A 1/1998 Stump
5,745,074 A 4/1998 Laude
5,791,815 A 8/1998 Rowe
5,862,501 A 1/1999 Talbot et al.
5,903,235 A 5/1999 Nichols
5,924,817 A 7/1999 Godbersen
5,929,807 A 7/1999 Viney et al.
5,935,183 A * 8/1999 Sahm et al. ..... 701/50
5,941,659 A 8/1999 Godbersen
5,944,770 A 8/1999 Enge et al.
5,951,613 A * 9/1999 Sahm et al. ..... 701/50
5,977,908 A 11/1999 Nichols
5,984,420 A 11/1999 Murray et al.
5,988,936 A 11/1999 Smith
6,027,282 A 2/2000 Horn
6,033,031 A 3/2000 Campbell
6,047,227 A 4/2000 Henderson et al.
6,052,083 A 4/2000 Wilson
6,055,486 A 4/2000 Minnich et al.
6,067,046 A 5/2000 Nichols
6,099,204 A 8/2000 Godbersen
6,109,111 A 8/2000 Heimbruch et al.
6,109,825 A 8/2000 Yon
6,119,376 A 9/2000 Stump
6,171,016 B1 1/2001 Pauls et al.
6,171,018 B1 1/2001 Ohtomo et al.
6,191,732 B1 2/2001 Carlson et al.
6,195,922 B1 3/2001 Stump
6,234,713 B1 5/2001 Rowe et al.
6,253,160 B1 6/2001 Hanseder
6,286,607 B1 9/2001 Ohtomo et al.
6,295,746 B1 10/2001 Meduna et al.
6,304,210 B1 10/2001 Allison et al.
6,312,194 B1 11/2001 Simons
6,330,503 B1 12/2001 Sharp et al.
6,332,736 B1 12/2001 Cape et al.
6,364,028 B1 4/2002 Ferrell et al.
6,367,764 B1 4/2002 Butler
6,371,566 B1 4/2002 Haehn
6,384,823 B1 5/2002 Donoghue
6,386,793 B1 5/2002 Lenz et al.
6,421,926 B1 7/2002 Cappuccio
6,425,186 B1 7/2002 Oliver
6,427,441 B2 8/2002 Wustefeld et al.
6,430,504 B1 8/2002 Gilbert et al.
6,457,779 B1 10/2002 Busley et al.
6,467,383 B1 10/2002 Charbonnier
6,467,992 B1 10/2002 Dietrich
6,471,442 B1 10/2002 Deeb et al.
6,477,795 B1 11/2002 Stump
6,481,924 B1 11/2002 Smolders et al.
D467,824 S 12/2002 Svendsen et al.
6,497,531 B2 12/2002 Sipherd et al.
6,508,606 B1 1/2003 James, III et al.
6,520,716 B2 2/2003 Rower
6,529,828 B1 3/2003 Williams et al.
6,540,435 B1 4/2003 Lizarraga
6,577,141 B2 6/2003 Gandrud
6,579,037 B2 6/2003 Guntert et al.
6,582,152 B2 6/2003 Leone et al.
6,587,891 B1 7/2003 Janky et al.
6,594,912 B2 7/2003 Ashjaee
6,628,308 B1 9/2003 Greenberg et al.
6,633,256 B2 10/2003 Zhdanov et al.
6,640,687 B1 11/2003 Frantz et al.
6,655,465 B2 12/2003 Carlson et al.
6,655,869 B1 12/2003 Deeb et al.
6,679,649 B1 1/2004 Capolupo
6,692,185 B2 2/2004 Colvard
6,701,647 B2 3/2004 Stump
6,709,195 B2 3/2004 Piccoli et al.
6,711,838 B2 * 3/2004 Staub et al. ..... 37/348
6,715,957 B2 4/2004 Colvard et al.
6,736,216 B2 5/2004 Savard et al.
D492,306 S 6/2004 Martin et al.
6,772,565 B1 8/2004 Schlitz et al.
6,782,320 B1 8/2004 Bahder
6,791,492 B2 9/2004 Miyasaka et al.
6,799,922 B2 10/2004 Smith
6,805,516 B2 10/2004 Barnat et al.
6,817,253 B2 11/2004 Gandrud
6,837,046 B2 1/2005 Gollner
6,841,100 B2 1/2005 Seppanen
6,849,211 B2 2/2005 Jarvinen et al.
6,862,525 B1 3/2005 Beason et al.
6,871,138 B1 3/2005 Minelli
6,872,028 B2 3/2005 Aeschlimann et al.
6,877,818 B1 4/2005 Gaertner et al.
6,880,643 B1 4/2005 Zimmerman et al.
6,883,815 B2 4/2005 Archer
6,890,123 B2 5/2005 Piccoli
6,904,394 B2 6/2005 Jaffrey
6,912,455 B2 6/2005 Beek
6,916,070 B2 7/2005 Sehr
6,923,290 B1 8/2005 MacLeod et al.
6,923,630 B2 8/2005 Allen
6,925,892 B2 8/2005 Gandrud
6,934,631 B2 8/2005 Dentinger et al.
D509,760 S 9/2005 Burrell et al.
6,947,820 B2 9/2005 Ohtomo et al.
6,950,059 B2 9/2005 Rapoport et al.
6,966,387 B2 11/2005 Marriott, Jr. et al.
6,966,859 B2 11/2005 Pollman
6,970,069 B1 11/2005 Murphy
6,971,472 B2 12/2005 Pedersen et al.
6,984,089 B1 1/2006 Colvard
7,003,386 B1 * 2/2006 Ericsson et al. ..... 701/50
7,393,156 B1 7/2008 Dunstan
2003/0074812 A1 4/2003 Stump
2004/0028476 A1 2/2004 Payne et al.
2004/0057795 A1 * 3/2004 Mayfield et al. ..... 404/84.05
2004/0161299 A1 8/2004 Smith
2004/0168358 A1 9/2004 Stump
2005/0264445 A1 12/2005 Brabec et al.
2006/0198700 A1 * 9/2006 Maier et al. ..... 404/84.1
2007/0058161 A1 * 3/2007 Nichols et al. ..... 356/139.01
2008/0253835 A1 10/2008 Messinger et al.

FOREIGN PATENT DOCUMENTS

JP 2000500195 A 1/2000
JP 2000319815 A 11/2000
JP 2001512543 A 8/2001
KR 1020050115234 A 12/2005
WO WO 95/34849 * 12/1995
WO 2008124657 A1 10/2008

OTHER PUBLICATIONS

Information Disclosure Statement (IDS) letter regarding common patent application(s), dated Jul. 20, 2011.

* cited by examiner prior art

100

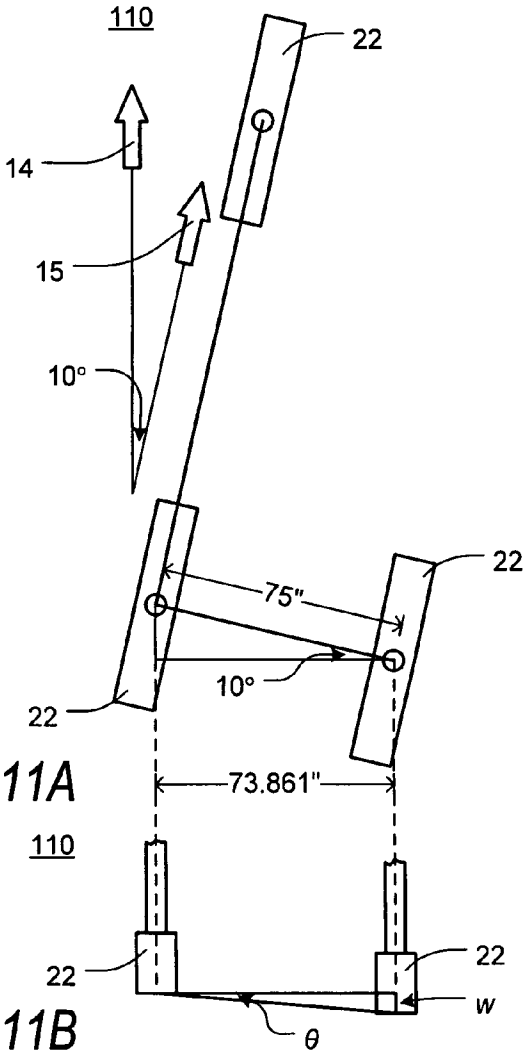
FIG. 11A
FIG. 11B
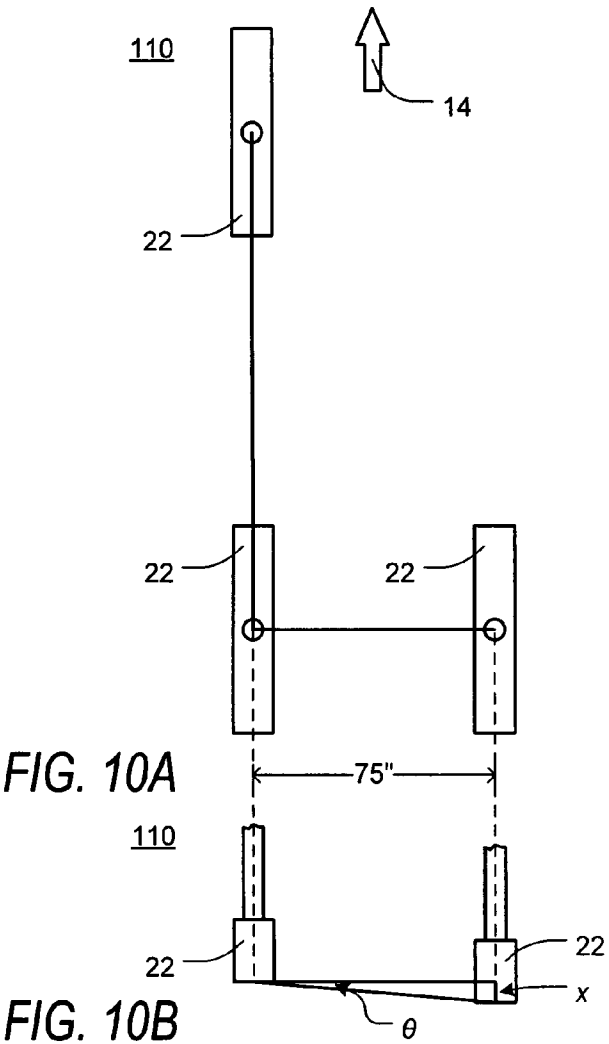
FIG. 10A
FIG. 10B

3D CONTROL SYSTEM FOR CONSTRUCTION MACHINES

CROSS-REFERENCE TO RELATED APPLICATION

The present application is a U.S. nonprovisional patent application of, and claims priority under 35 U.S.C. §119(e) to, each of: U.S. provisional patent application Ser. No. 60/910,243, filed Apr. 5, 2007, U.S. provisional patent application Ser. No. 60/910,247, filed Apr. 5, 2007, and U.S. provisional patent application Ser. No. 60/910,251, filed Apr. 5, 2007, and each of these provisional patent applications is incorporated by reference herein.

COPYRIGHT STATEMENT

All of the material in this patent document is subject to copyright protection under the copyright laws of the United States and of other countries. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE PRESENT INVENTION

1. Field of the Present Invention

The present invention relates generally to automated control of construction equipment, and, in particular, to the use of geodetic devices and information derived therefrom to automatically control, in three dimensions, the operation of slip form paving equipment and other construction equipment.

2. Background

In the construction industry, a longstanding issue has been how to accurately determine, on the construction site, the desired location for a building, road or other construction project as specified in plans developed by an architect, engineer, or the like. Most commonly, surveying techniques, supplemented in recent decades by advances in surveying technology, have been used to pinpoint and mark precise locations on a construction site, thereby guiding construction workers as they work.

Unfortunately, during construction, the locations marked by the surveyors may be affected by the construction process itself. For example, stakes that are laid out by surveyors to mark the edges of a planned road may be moved, covered or destroyed by earth-moving equipment as excavation, fill or the like is carried out. As a result, construction must often be halted temporarily while surveyors reestablish the construction locations, and the earth-moving process is continued.

More recently, advances in global positioning system ("GPS") technology have begun to find applicability in the construction industry. Perhaps most obviously, GPS technology is now widely used by surveyors because it permits actual physical locations to be determined with accuracy to the nearest hundredth of a foot. Because the plans for most construction projects today are developed via computer, such techniques are particularly useful because the plans can be coordinated with the GPS data, thereby providing precise guidance during the surveying process.

In addition, however, GPS has begun to be used to guide the operation of construction equipment during the construction process itself. In fact, the use of so-called three-dimensional ("3D") controls to direct the operation of construction equipment is becoming increasingly common, particularly with regard to earthmoving equipment. A typical implementation of a 3D control system in such a context involves the use of one or more fixed base stations, located in and around the construction site, coupled with one or more mobile units respectively disposed on the various pieces of construction equipment that are to be controlled via the system. As described below, the type of control system used may vary, but in each case, the exact position of each base station may be established by conventional surveying means, optionally supplemented by the use of GPS technology.

In one type of 3D control system, the mobile unit is a GPS unit, and thus the position of the mobile unit, and indirectly, the construction equipment on which it is carried, may be determined with some accuracy using only the mobile unit. However, in this arrangement, the GPS data developed by the mobile unit may be supplemented and adjusted, as appropriate, using additional location data from the fixed base stations, the position of each of which is known with great accuracy. This, in turn, provides highly accurate information about the exact position of the mobile unit, and indirectly, the construction equipment. Of course, as is well known, a stationary GPS unit, by itself, can not directly indicate any direction or orientation.

More commonly, however, the base station is a robotic laser-based tracking station, sometimes called a "total station," and the mobile unit is a prism, wherein the robotic tracking station produces one or more lasers and directs them toward the construction equipment, and more particularly, toward the prism, which is mounted in a prominent location on the construction equipment to maximize its ability to receive the laser. In this type of 3D control system, the laser is used to determine the position of the prism relative to the base station by calculating distance and angle. Because the position of the base station is known, the position of the prism, and indirectly the position of the construction equipment, may be established using the combination of the fixed location information developed or known by the base station (which may or may not utilize GPS information) and the relative positional information provided using the laser and prism.

Unfortunately, the use of prisms creates a number of complications. First, in order to maintain line-of-sight between the prism and the robotic tracking station, the prism is usually elevated above what it is measuring or controlling. As a result, the center of the prism usually cannot be physically held at the point you want to measure or locate. Thus, because the point being measured is always offset from the center of the prism, manual point location is currently achieved by placing the prism on a pole, of known length, and then by aligning and hold the poll plumb to the earth. This process, although very common, is time consuming and is prone to operator error.

Further, like a GPS device, a prism can only be used to locate a single XYZ point in space. A stationary prism, by itself, thus can not directly indicate any direction or orientation.

Still further, a robotic tracking station can only track one prism at a time. Using multiple prisms (e.g., two or three) will allow direction (using two prisms) or orientation (using three prisms) to be determined, but doing so requires additional robotic stations to be setup and calibrated.

Regardless of which type of system is used to determine it, position by itself is not sufficient to control the operation of the equipment. For example, steering a mobile machine further requires knowledge of the machine's orientation in two-dimensional space. Conventionally, the machine's orientation is determined indirectly as being closely related to the machine's direction of travel. Currently, determining a machine's travel direction involves comparing the machine's current location, determined via one of the previously-described systems, to its previous location. The vector defined by those two points approximately defines the machine's current direction of travel.

Unfortunately, this approach includes a number of inherent inaccuracies. First, this approach is dependent upon sufficient movement by the machine in a straight forward direction. The approach cannot work at all if the machine is not moving, because direction of travel cannot be determined in this way if the current location and the previous location are the same. Further, the approach may be highly inaccurate if the current location and the previous location are particularly close to each other, which may happen if the machine is operating in a confined area or is of a type that can spin in place or turn with a very tight turning radius.

For example, FIG. 1 is a plan view illustrating the path of a reference point 2, such as where a prism is likely to be mounted, on a conventional slip-form curbing machine 10 that is being used to form a curb 40 having a curved section of uniform radius. As the curbing machine 10 moves along the ground 12 in the direction of travel indicated by the arrows 14, the reference point 2 first follows a straight path that is substantially parallel to the course of the straight curb 40 being formed (i.e., the section of curb 40 shown at the bottom of FIG. 1). However, the path 4 of the reference point 2 begins to diverge from the course of the curb 40 when the curb begins curving. In particular, the path 4 of the reference point remains straight for a significant distance before its curvature begins to match that of the curb 40 itself. Notably, the effective distance between the path 4 of the reference point 2 and the course of the curb 40 is significantly greater along the curved section of the curb 40 than along the straight sections of the curb 40. When the curb 40 straightens out again, the reference point path 4 must thus make an adjustment to return to the lesser spacing that exists along straight sections of the curb 40. Overall, then, the dissimilarities between the path 4 of the reference point 2 and the course of the curb 40 in FIG. 1 thus graphically illustrate the inherent difficulty of tracking and controlling a construction machine 10 using a single reference point 2 on that machine 10.

Although not illustrated in FIG. 1, another inaccuracy stems from the fact that machine orientation is not exactly equivalent to direction of travel. For example, it is impossible to determine precisely whether the path traveled by the machine from its previous location to its current location followed a straight line or a curved one. The orientation of the machine at the current location will be different if the machine followed a straight line to get there than if it followed a curved one.

Yet another inaccuracy stems from the use of positional data for only a single point (the point at which the mobile unit is positioned on the machine) to represent the position of the entire machine. In fact, most machines are several meters wide, several meters long and at least a couple of meters high. Because GPS (coupled with one of the systems described above) may be used to determine location to accuracies of considerably less than a meter, the positional data thus determined is accurate only for a small part of the machine, i.e., the exact location of the mobile unit on the machine. The position or location of other parts of the machine, such as the machine's operational components, may be determined only by combining information about the relative disposition of the mobile unit on the machine with knowledge of the geometry of the machine. For machines whose typical use involves travel only in a linear direction, and deviations from such travel occur only infrequently, this approximation may be acceptable. However, for other types of machines that turn regularly, or whose operational components move or are adjusted dramatically relative to the rest of the machine (for example, excavator shovels), the error induced between the fixed position of the mobile unit and the position or orientation of the operational components can become dramatic, thus rendering the use of such a system unsuitable for controlling certain types of machines.

The significance of this problem increases in relation to the degree of independence with which the operational components of the machine move relative to the movement of the machine itself. For example, in a curbing machine, the slip forming equipment mounted on the machine is typically adapted to form curbs having very short radiuses of curvature while the machine itself moves forward or stops altogether. In such a process, the movement of the operational components is thus very different from the movement of the machine itself. Conventional 3D control systems are ill-equipped to address this issue.

Paving and curbing equipment further require the attitude of the machine side-to-side (generally referred to as "cross slope") and the attitude of the machine front-to-back (generally referred to as "long slope") to be accurately controlled in order to maintain the proper three-dimensional form (side-to-side and front-to-back) of the pavement or curbing being formed. Traditionally, the machine location, direction, and long slope is referenced from a string line, as better described below, that is placed ahead of time to guide the location of the slip-forming equipment on the machine, while cross slope is monitored by a cross slope sensor. To better illustrate this and other limitations of conventional 3D control systems with regard to paving apparatuses, the following description of a conventional paving apparatus is presented, wherein FIG. 2 is a perspective view of a conventional slip form paving apparatus 10 such as is illustrated schematically in FIG. 1. The paving apparatus 10 is illustrated in FIG. 2 traveling over a ground surface 12 in the direction indicated by the arrow 14. The paving apparatus 10 comprises a main frame 20 supported substantially horizontally on a plurality of ground engaging members 22. Often, a single front ground engaging member 22, which is steerable, and a pair of rear ground engaging members 22 are mounted to the main frame 20 in a triangular relation to each other to provide stable suspension of the frame 20 in a generally horizontal position above the ground surface 12.

A mold 32 having a desired cross sectional shape corresponding to the cross sectional shape of the structure to be formed, such as a curb and gutter structure, is supported by the frame 20 and positioned on one side of the paving apparatus 10 to facilitate continuous slip forming of a concrete curb and gutter such as are typically formed along the sides of a roadway during road construction. The paving apparatus 10 also includes a hopper 34 and a conveyor 36. Together, the conveyor 36 and hopper 34 are adapted to receive concrete or other flowable paving material 38 from a separate paving material supply (not shown) and to convey the flowable paving material 38 to the mold 32. Flowable paving material 38 is continuously supplied to the mold 32 such that a continuous paving structure 40 is formed on the ground surface 12 as the paving apparatus 10 moves along the ground.

The ground surface 12 on which the paving structure 40 is to be laid in molded form is typically prepared in advance by suitable construction grading equipment. At least partially because of the problems described above, it is common practice during such preparations to construct an external datum from which the position of the curb or other paving structure can be determined. Typically, the external datum used consists of a string line 16 supported by a plurality of line holders 18, each of which includes a stake and a rod. Using an external datum such as a string line has traditionally proven advantageous because paver operations may be automatically controlled using various sensors for determining the position of the paving apparatus 10 relative to the string line 16.

Specifically, the paving apparatus 10 is often provided with a steer sensor 42, front grade sensor 46, rear grade sensor 48, and a slope sensor 49 (shown in FIG. 3). The steer sensor 42 and grade sensors 46,48 are neutral or "null" seeking, and each may be either a contact type sensor having a wand contacting the string line or a non-contact type sensor such as those using ultrasonic ranging or other non-contact sensing technologies. As illustrated in FIG. 2, the steer sensor 42 includes a steer sensor wand 44 and the front and rear grade sensors 46,48 include grade sensor wands 50. It should be noted that the steer and grade sensors 42,46,48 may be mounted on the paving apparatus 10 in a manner that allows the sensors to be horizontally and vertically adjustable relative to the paving apparatus 10. The mounting apparatus used, however, typically allows for the position of the steer and grade sensors 42,46,48 to be fixed relative to the paving apparatus 10 during paving operations.

The paving apparatus 10 is positioned on the ground surface 12 upon which the paving structure 40 is to be laid in such a manner that the mold 32 is located relative to the string line 16 in the position that the paving structure 40 is desired to be laid. The steer sensor wand 44 and grade sensor wands 50 are in contact with the string line 16 such that the wands are tangent to the string line 16. Generally, it is preferable to use two grade sensors 46,48, one on the front of the frame 20 and one on the rear of the frame 20. Each steer and grade sensor 42,46,48 produces an electrical output signal in proportion to the deflection of its respective wand from the neutral or null position. Preferably, a slope sensor 49 is located on the paving apparatus 10 to detect changes in cross slope as the apparatus 10 travels over the ground 12 and to generate an output signal proportional to the change in cross slope detected. Slope sensors may be, but are not required to be, of the dampened pendulum type.

The main frame 20 of the paving apparatus 10 is supported on the ground engaging members 22 by a plurality of posts, which are independently extendable or retractable to vary the position of the main frame 20 with respect to the ground engaging members 22. Because the mold 32 is also supported by the main frame 20, changing the position of the frame 20 changes the position of the mold 32 as well. The posts are typically operated by hydraulic piston-cylinder mechanisms 52,54,56 or, alternatively, the posts may be threaded posts that are rotated by associated reversible hydraulic motors. Three such piston-cylinder mechanisms are illustrated in FIG. 2, including a front grade piston-cylinder mechanism 52, a rear grade piston-cylinder mechanism 54, and a slope piston-cylinder mechanism 56. The front grade piston-cylinder mechanism 52 illustrated in FIG. 2 is supported by a ground engaging member 22 that includes a hydraulically operated steering mechanism, which may be a piston-cylinder mechanism or a hydraulically operated threaded post mechanism, that rotates the ground engaging member 22 relative to the front grade piston-cylinder mechanism 52 to thereby steer the paving apparatus 10.

Automatic paving operations may be conducted using the sensors 42,46,48 and piston-cylinder mechanisms 52,54,56 described above. After the paving apparatus 10 and sensors 42,46,48 are correctly positioned relative to the string line 16, paving apparatus 10 travel and paving operations may commence. When deviations in the horizontal direction of paving apparatus 10 travel are detected by the steer sensor 42, the steer sensor 42 generates an output signal used to operate a steering servo valve, which directs hydraulic fluid to the appropriate port on the steering mechanism in order to turn the steerable ground engaging member 22 in the direction required to return the steer sensor wand 44 to its neutral or null position. The paving apparatus 10 may further include an additional sensor (not shown) to measure the steered angle of the ground engaging members 22. The steering sensors command a proportional steered angle wherein the ground engaging member 22 steers and then remains at a fixed angle relative to the steering sensor.

Similarly, deviations in the vertical direction of the main frame 20 relative to the string line 16 are detected by the front and rear grade sensors 46,48 each of which generate an output signal used to control a servo valve associated with the front grade piston-cylinder mechanism 52 and the rear grade piston-cylinder mechanism 54, respectively. The piston-cylinder servo valves control extension or retraction of their associated piston-cylinder mechanisms 52,54,56 to return the frame 20 to a position in which the front and rear grade sensors 46,48 are in their null position.

Changes in mold cross slope as the paving apparatus 10 travels are detected by the slope sensor 49, which generates an output signal used to control a servo valve associated with the slope piston-cylinder mechanism 56, located on the opposite side of the frame 20 from the string line 16. Extension or retraction of the slope piston-cylinder mechanism 56 is used to change the position of one side of the frame 20 in order to compensate for changes in ground slope or to induce a desired cross slope on the mold 32. Although only one slope piston-cylinder mechanism 56 is shown in FIG. 2, additional slope posts or piston-cylinder mechanisms may also be used.

Typically, a pulse pickup device (not shown) is installed on the hydraulic motor of a driven ground engaging member 22 to generate a signal used to a determine the distance the paving apparatus 10 travels and the speed of the travel of the paving apparatus 10.

Proper control of the paving apparatus 10, and particularly of the mold 32, depends on proper determination and use of a variety of geometric relationships. For example, in many applications, it is desirable for slip form pavers to control the mold position during paving operations such that the cross slope of the mold is changed as the paving apparatus 10 travels along the string line 16 to thereby produce a paving structure 40 having a variable cross slope. Put another way, the paving apparatus 10 travels along a ground surface 12 that has a cross slope, and the paving apparatus 10 is capable of positioning the mold 32 with respect to the ground surface 12 such that the mold 32 itself has a cross slope.

Determination of the proper mold position is conventionally dependent on the determination of the current and/or proper mold position relative to the string line 16. FIG. 3 is a schematic diagram illustrating the relationship between the mold 32, the string line 16, and the control system sensors for the conventional paving apparatus 10 of FIG. 2. The value or angle of the cross slope for a particular mold is the value of the angle formed between the ground surface 12 and an imaginary reference plane 58 enclosing the bottom of the mold 32, when viewed in the transverse direction relative to the paving apparatus' direction of travel 14. Whenever it is desired to extrude a paving structure 40 having a transverse angle equal to the slope of the ground surface 12, then there would be no cross slope on the mold 32 for use in forming the given structure 40. In other words, the mold 32 would be level relative to the ground surface 12.

The determination of proper mold position is even more complicated in those applications in which it is desirable to form a paving structure 40 having a cross slope that is different from the slope of the ground surface 35 onto which the structure is laid. For example, it is often desirable when making gutters or curb and gutter structures 40 to form the gutter pan with either a "catch" or "spill" angle as previously described. Transitioning between an initial mold cross slope and a desired or altered mold cross slope during paving apparatus 10 travel along the string line 16 can be accomplished automatically as described, for example, in commonly-assigned U.S. Pat. No. 6,109,825, the entirety of which is incorporated herein by reference. In FIG. 3, the mold 32 is shown in a paving operation in which the ground surface 12 has zero slope and in which there is no cross slope on the mold 32. The steer sensor wand 44 and the grade sensor wand 50 are in contact with the string line 16 and the mold 32 is adjacent the ground surface 12 in a position relative to the string line 16 in which it is desired to form a curb and gutter structure 40. An imaginary control line 62 extends between the string line 16 and the slope sensor 49. Notably, the slope sensor 49 is illustrated only schematically in FIG. 3; this illustration does not therefore attempt to show the position of the pendulum in the slope sensor 49 at a given time. The desired location of the mold 32 relative to the string line 16 is measured as the distance, broken into a vertical mold distance ("VMD") and a horizontal mold distance ("HMD"), between the string line 16 and a predetermined reference point 60 on the mold 32. Where the mold 32 is a curb and gutter mold, the predetermined reference point 60 on the mold 32 is often the intersection of the back of curb ("BOC") and the top of curb ("TOC"). A cross slope may be established by extending or retracting the slope piston-cylinder mechanism 56. The extension or retraction of slope piston-cylinder mechanism 56 causes rotation of the mold and control sensors around the control string line 16, illustrated by double-pointed dotted lines in FIG. 3. For example, a cross slope may be established by extending the slope piston-cylinder mechanism 56, in which case the reference point 60 on the mold 32 moves up and to the right along the arcuate path illustrated in FIG. 3. The magnitude of the movement of the mold 32 in the horizontal and vertical directions may each be caused calculated as a function of the cross slope angle. Unfortunately, the extension or retraction of the slope piston-cylinder mechanism 56 causes numerous downstream interrelated effects that must be managed. Some of these problems, and one possible solution therefor, are discussed in the aforementioned '825 patent.

Solutions such as those described in the '825 patent, however, are dependent upon the use of a conventional string line 16 to control the paving apparatus 10. If a 3D control system of one of the types described hereinabove is applied to such equipment, the only information continuously established with regard to the machine is the location of the single mobile unit (most often, a prism); all other information must be extrapolated, with varying degrees of accuracy, or must be developed using other means. For example, the determination of long slope for the equipment requires an additional sensor over and above the cross slope sensor. Such a sensor is not usually provided on string line-controlled machines, and thus represents an additional complication in the application of conventional 3D control systems to, for example, paving and curbing machines.

Not to be ignored is the traditional importance of the string line 16 in establishing, indirectly, the location of other features as well. Conventionally, the string line 16 is one of the first construction elements put in place on a construction site. Other construction elements are either placed based directly on the string line 16 or are placed based on the paving structure 40 that is built by the paving apparatus 10.

In view of all of the foregoing, a need exists for a 3D control system for construction equipment, particularly paving and curbing equipment, that may be used reliably to guide the operation of such equipment. Such a control system needs to be able to determine geodetic information about the equipment, including its location, direction and orientation, with sufficient accuracy to be relied on to replace the use of string lines 16 and other technology in the construction environment.

SUMMARY OF THE PRESENT INVENTION

Broadly defined, the present invention according to one aspect includes a construction system utilizing 3D control including a fixed base station of known location; a self-propelled construction machine located in the general vicinity of the fixed base station; and a rotating mobile unit assembly mounted on the self-propelled construction machine and having a location-determination device arranged to rotate around an axis, the location-determination device adapted to operate in conjunction with the fixed base station to determine geodetic information about the self-propelled construction machine.

In features of this aspect, the geodetic information includes the location of the self-propelled construction machine, the direction of the self-propelled construction machine, and the orientation of the self-propelled construction machine. In another feature, the construction system further comprises a machine controller adapted to control one or more operational functions of the self-propelled construction machine based on the geodetic information. In a further feature, the location-determination device is a geodetic prism, and the fixed base station is a total station.

The present invention according to a second aspect includes a 3D controlled construction apparatus including a self-propelled construction machine; a rotating mobile unit assembly mounted on the self-propelled construction machine and having a location-determination device arranged to rotate around an axis, the location-determination device adapted to operate in conjunction with a fixed base station to determine geodetic information about the self-propelled construction machine; and a machine controller adapted to control one or more operational functions of the self-propelled construction machine based on the geodetic information.

In features of this aspect, the geodetic information includes the location of the self-propelled construction machine, the direction of the self-propelled construction machine, and the orientation of the self-propelled construction machine.

The present invention according to a third aspect includes a rotating mobile unit assembly for 3D control of a self-propelled construction machine including a mounting assembly adapted to be mounted on a self-propelled construction machine; a location-determination device supported by the mounting assembly and arranged to rotate around an axis; and a sensor adapted to determine the angular orientation of the location-determination device.

The present invention according to a fourth aspect includes a method of controlling a self-propelled construction machine including mounting a mobile assembly, having a location-determination device that revolves around an axis, on a self-propelled construction machine; repeatedly determining a location of the location-determination device as the location-determination device revolves around the axis; and utilizing data indicative of the repeatedly-determined locations to control the operation of the self-propelled construction machine.

In a feature of this aspect, the step of repeatedly determining a location is carried out in conjunction with a fixed base station. In accordance with this feature, the step of utilizing the data to control the operation of the self-propelled construction machine includes utilizing the data to steer the self-propelled construction machine; utilizing the data to adjust the cross slope of the self-propelled construction machine; and utilizing the data to adjust the long slope of the self-propelled construction machine.

The present invention according to a fifth aspect includes a handheld mobile unit assembly including a surveying pole; a location-determination device supported by the surveying pole and arranged to rotate around an axis; and a sensor adapted to determine the angular orientation of the location-determination device.

In features of this aspect, the location-determination device is a prism adapted to be tracked using laser technology, or the location-determination device is a GPS device.

The present invention according to a sixth aspect includes a method of determining a location on a construction site including providing a handheld mobile unit assembly, including a surveying pole with a rotating location-determination device mounted thereon; positioning a distal end of the surveying pole at a location of interest; holding the surveying pole steady while the location-determination device rotates at least one time about an axis; in conjunction with the operation of a fixed base station, determining the position of the location-determination device a plurality of times each time the location-determination device rotates about the axis; and determining a location on a construction site on the basis of the determined positions of the location-determination device.

The present invention according to a seventh aspect includes a method of determining a location on a construction site including providing a mobile unit assembly having a rotating location-determination device; determining a fixed geometric relationship between the location-determination device and a point of interest; repeatedly rotating the location-determination device around an axis; during each rotation, determining the location of the location-determination device a plurality of times; and determining a location of the point of interest on the basis of the determined positions of the location-determination device and the fixed geometric relationship.

In a feature of this aspect, the point of interest is a distal end of a surveyor's pole to which the rotating location-determination device is attached. In another feature of this aspect, the point of interest is a point on a construction machine. With regard to this feature, the point of interest is a point on a slip form paving machine. With further regard to this feature, the point of interest is a point on a mold of the slip form paving machine.

In additional features of this aspect, the location-determination device is a prism adapted to be tracked using laser technology, or the location-determination device is a GPS device.

The present invention according to an eighth aspect includes a 3D controlled paving apparatus including a slip form paving machine; a location-determination device supported by the slip form paving machine and arranged to rotate around an axis, the location-determination device adapted to operate in conjunction with a fixed base station to determine geodetic information about the slip form paving machine; and a machine controller adapted to control one or more operational functions of the slip form paving machine based on the geodetic information.

In features of this aspect, the location-determination device is a prism adapted to be tracked by the fixed base station using laser technology, or the location-determination device is a GPS device.

The present invention according to a ninth aspect includes a method of installing a 3D control system for a construction apparatus including mounting a rotating mobile assembly, having a location-determination device arranged to rotate around an axis, on a self-propelled construction machine having a forward direction; rotating the location-determination device until it points in a direction having a known angular relationship to the forward direction; determining, using an angular orientation sensor, the rotational angle of the location-determination device while the location-determination device points in the direction; and associating the determined rotational angle of the location-determination device with the known angular relationship of the direction to the forward direction.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein:

FIGS. 10A and 10B are a top plan view and a side plan view, respectively, of a paving apparatus whose direction of travel is being accurately determined;

FIGS. 11A and 11B are a top plan view and a side plan view, respectively, of a paving apparatus whose actual direction of travel is being inaccurately determined;

DETAILED DESCRIPTION OF THE PREFERRED EMBODIMENTS

Figure 1:
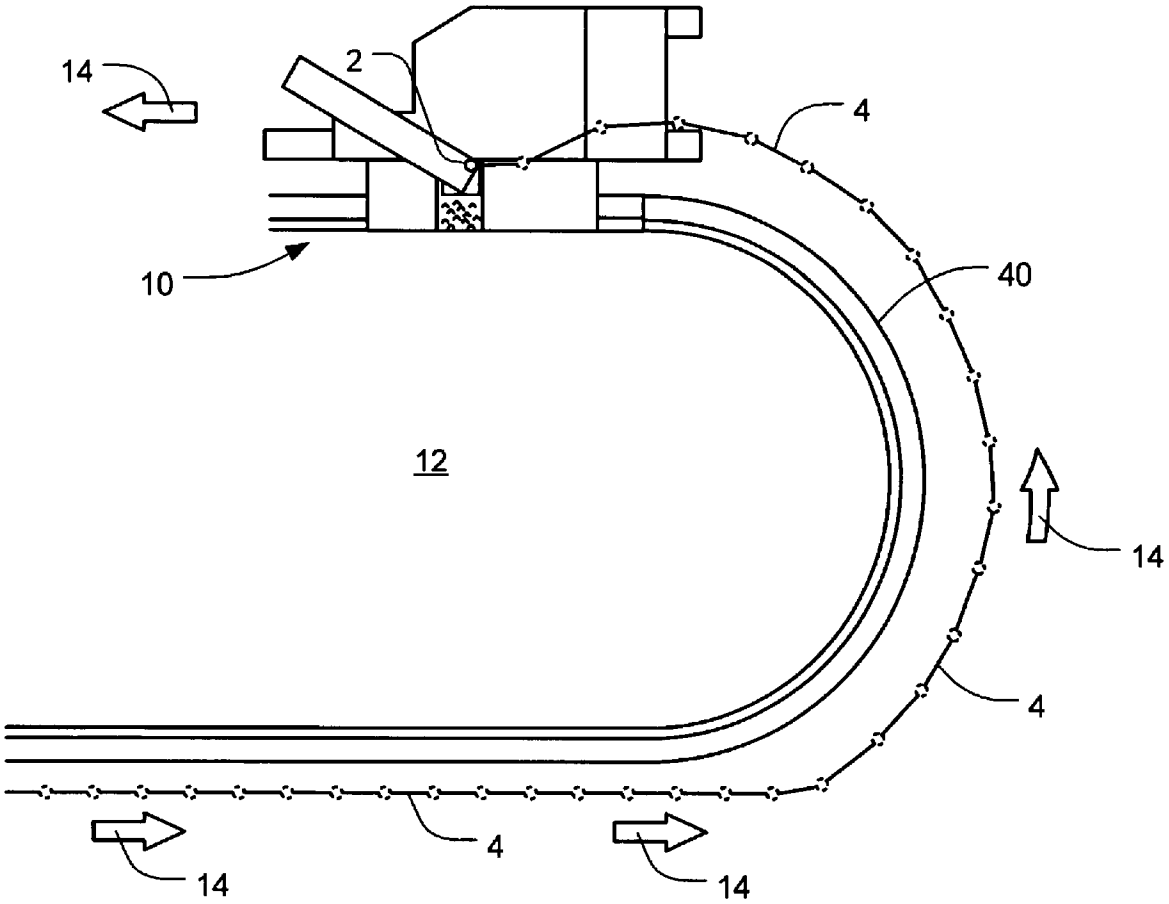
prior art FIG. 1
FIG. 1 is a plan view illustrating the path of a reference point, such as where a prism is likely to be mounted, on a conventional slip-form curbing machine that is being used to form a curb having a curved section of uniform radius.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, the preferred embodiments of the present invention are next described. The following description of the preferred embodiment(s) is merely exemplary in nature and is in no way intended to limit the invention, its application, or uses.

Figure 4:
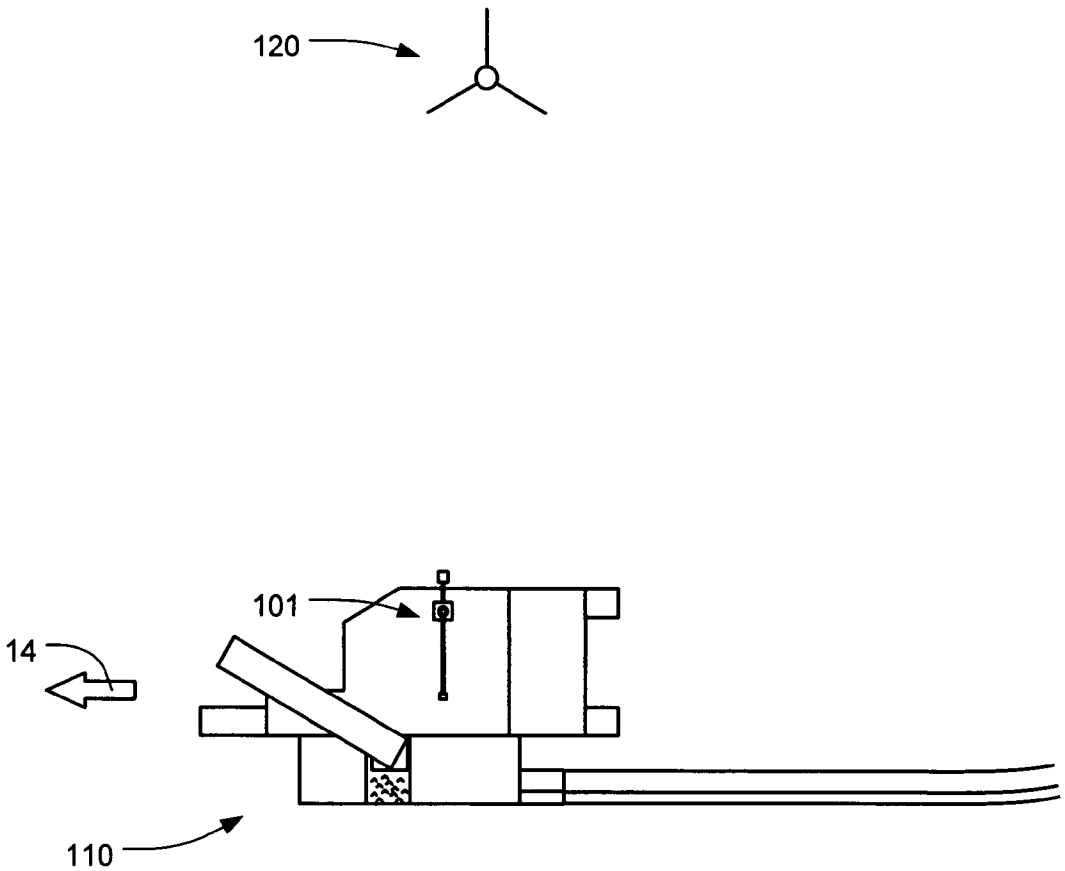
FIG. 4 is a plan view of the system of the present invention, as implemented on a paving apparatus, in accordance with a preferred embodiment of the present invention.

FIG. 4 is a plan view of the system 100 of the present invention, as implemented on a paving apparatus 110, in accordance with a preferred embodiment of the present invention. As shown therein, the system 100 includes a self-propelled construction machine 110, a rotating mobile unit assembly 101 and a fixed base station 120 located on the same construction site as, or otherwise in the general vicinity of, the construction machine 110. Because of the particular applicability of the system of the present invention to equipment for performing slip form paving operations, the construction equipment illustrated is a slip form paving apparatus 110. However, it will be apparent that the teachings of the present invention are equally applicable to many other types of construction equipment, including dozers, dozer blades, excavator shovels, concrete and asphalt pavers, road planers, tractors, and any other equipment that can benefit or be fitted with 3D controls. Each such piece of equipment may be referred to generally herein as a "self-propelled construction machine."

Figure 5:
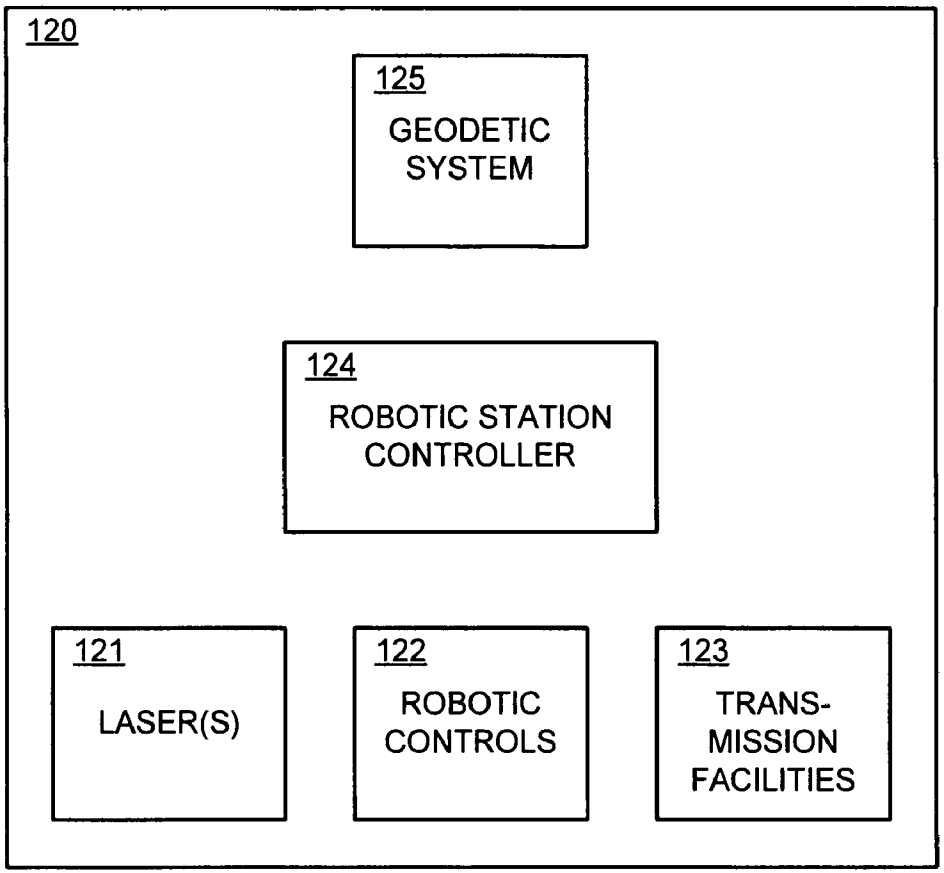
FIG. 5 is a block diagram illustrating some of the basic components of the base station of FIG. 4.

FIG. 5 is a block diagram illustrating some of the basic components of the base station 120 of FIG. 4. The rotating mobile unit assembly 101 and the fixed base station 120 may make use of any technology by which the exact position of a rotating mobile unit is determined using a fixed base station of known location. For ease in understanding the various features and aspects of the present invention, the embodiments described herein will generally include a mobile unit in the form of a prism that is tracked by a robotic tracking station, which in at least some versions is sometimes referred to as a "total station," using laser technology. However, it will be appreciated by the Ordinary Artisan that the robotic station used in the system of the present invention may be any of a variety of conventional robotic tracking stations whose function is simply to develop location information and send it to a handheld device or machine controller, and the mobile unit may be any geodetic or other location-determination device which, instead of a prism, may include a separate GPS device or may be tracked using RF tracking technologies. Furthermore, in some embodiments preferred for improved performance but requiring additional development, various non-conventional robotic station technologies may likewise be used.

In the embodiment shown in FIG. 5, the base station 120 is a robotic tracking station equipped with laser technology for tracking a prism 102, incorporated into the mobile unit assembly 101, using lasers 121, conventional robotic controls 122, a GPS or other geodetic system 125 for determining the position of the station 120, and facilities 123 for transmitting positional data to a machine controller 150 in the paving apparatus 110, described below, all managed by a controller 124. The position of the robotic station 120 in space may be determined with great accuracy using GPS technology. By extension, the position of the prism 102, and thus the paving apparatus 110, may also be determined with great accuracy by determining its position relative to the robotic station 120 and applying the known information about the position of the robotic station 120. The positional data transmitted by the base station 120 may be in a variety of forms, such as absolute data (defining the absolute location of the prism 102), relative data (defining the location of the prism 102 relative to that of the base station 120), error data (defining the deviation of the actual position of the prism 102 from its desired position), or any other usable form of positional data.

Figure 2:
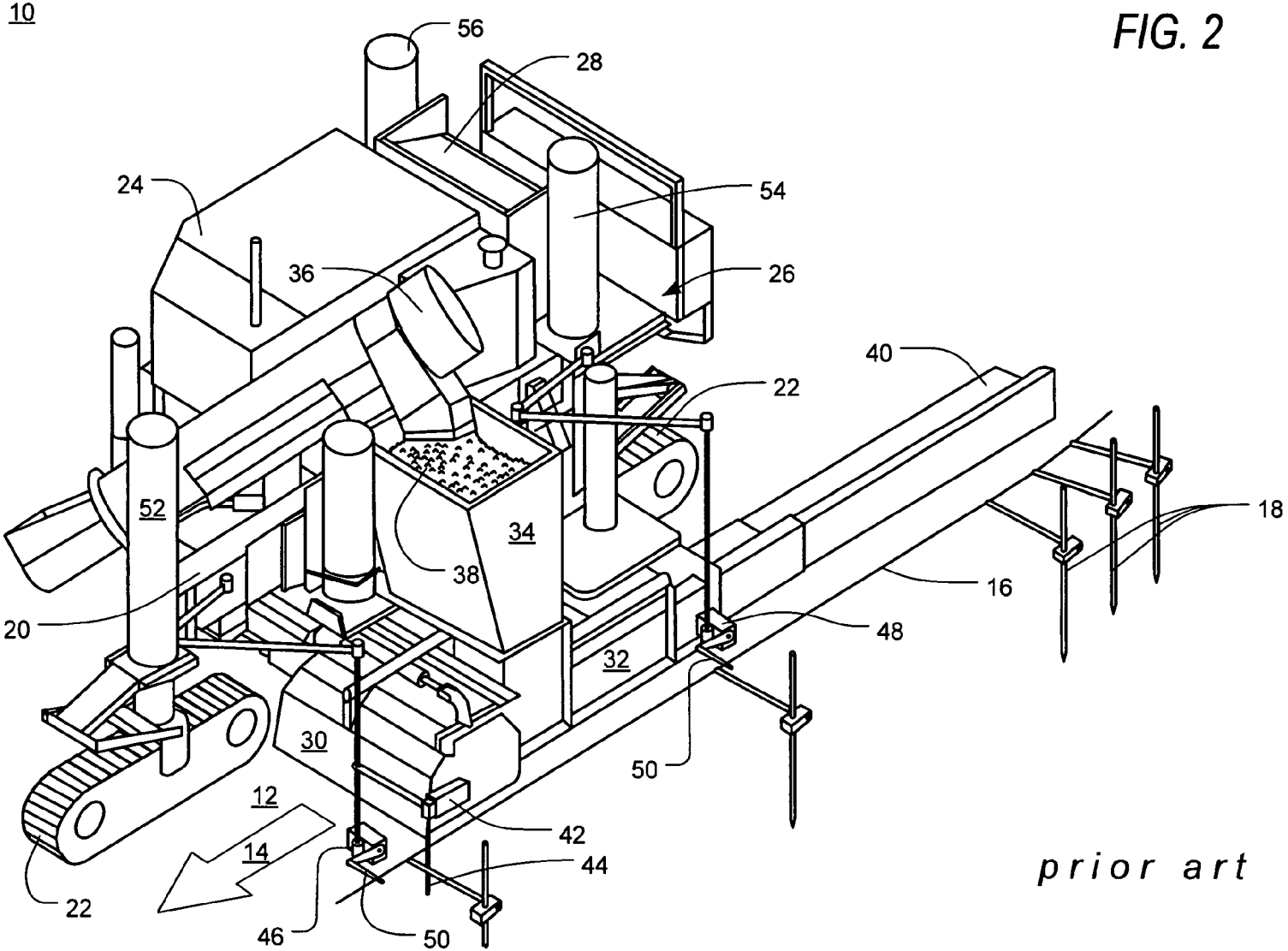
FIG. 2 is a perspective view of a conventional slip form paving apparatus such as is illustrated schematically in FIG. 1.
Figure 3:
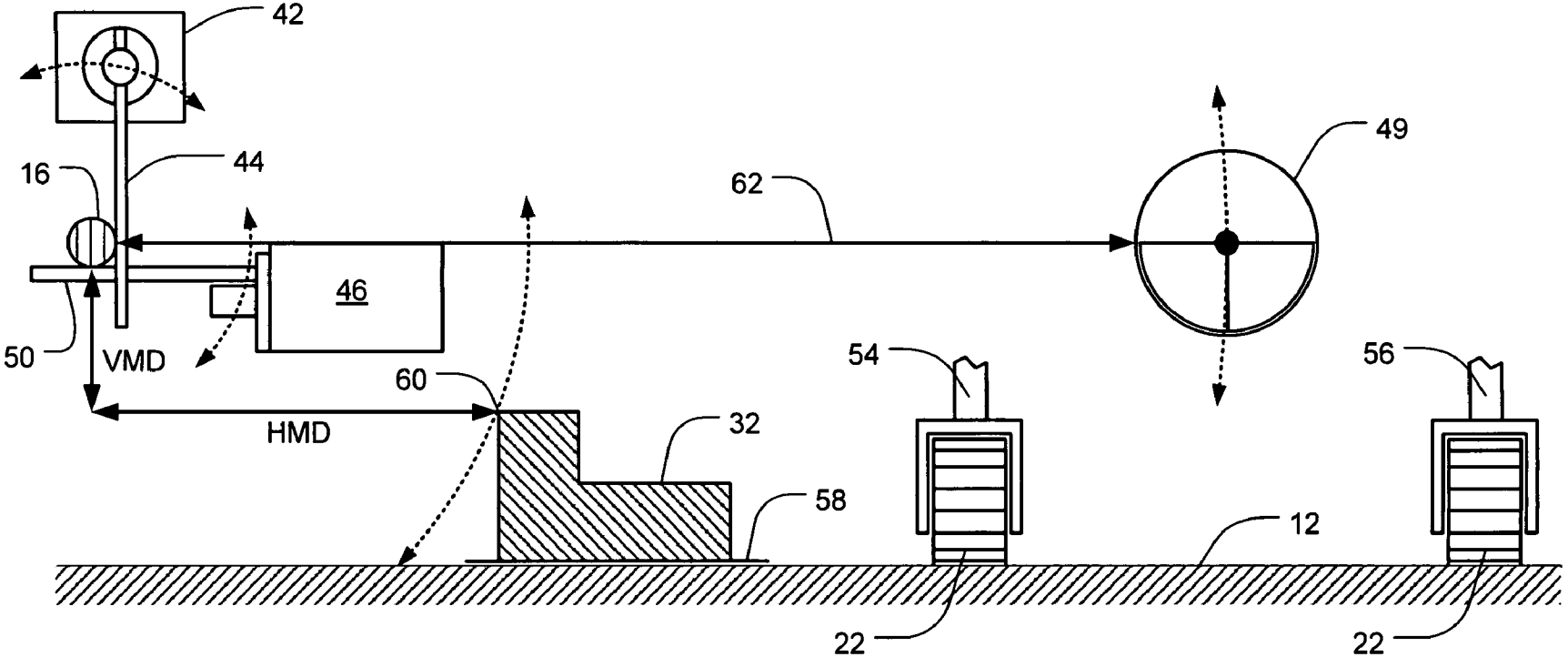
prior art FIG. 3
FIG. 3 is a schematic diagram illustrating the relationship between the mold, the string line, and the control system sensors for the conventional paving apparatus of FIG. 2.
Figure 6:
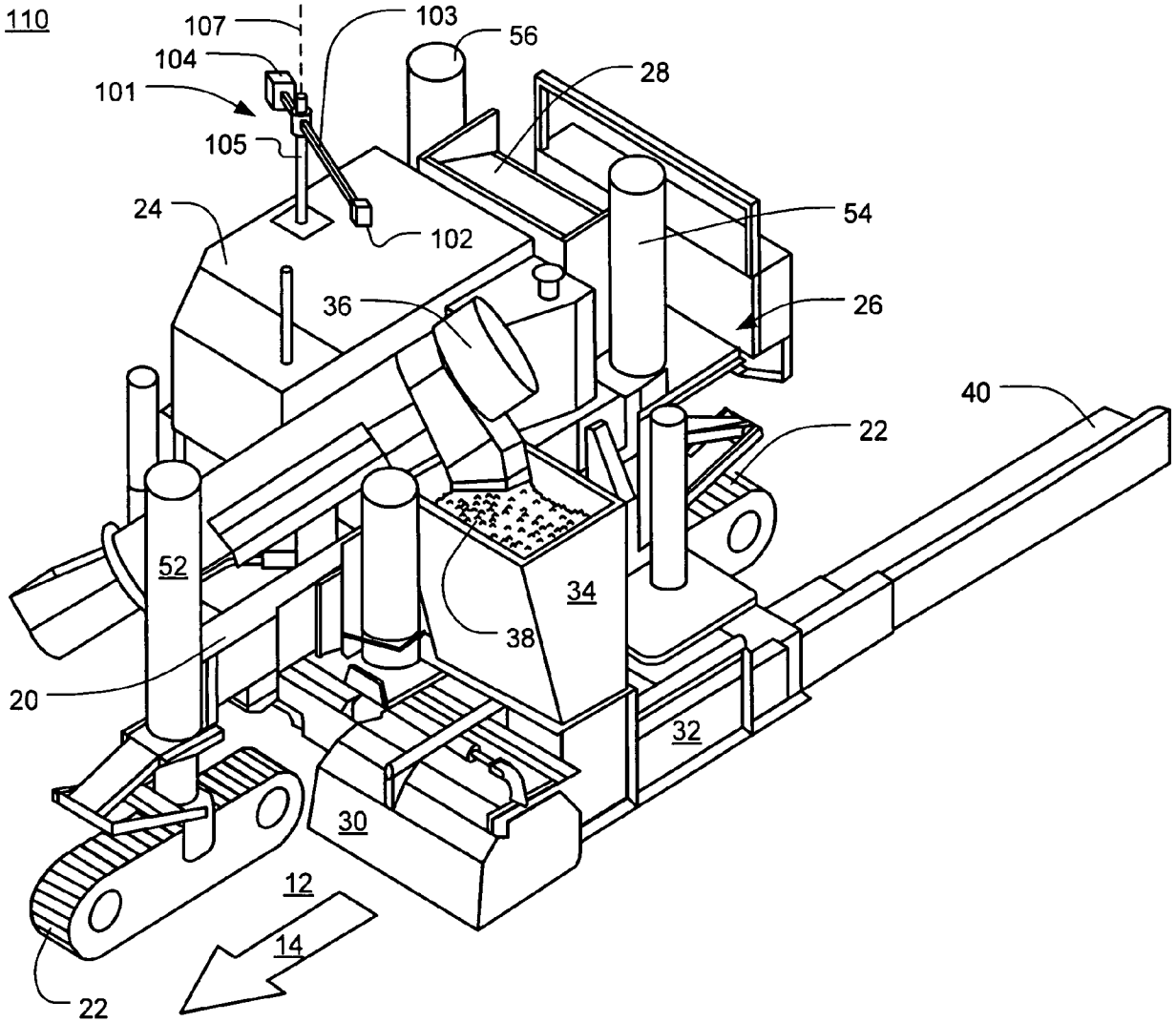
FIG. 6 is a perspective view of the slip form paving apparatus of FIG. 4.

FIG. 6 is a perspective view of the slip form paving apparatus 110 of FIG. 4. The paving apparatus 110 is illustrated in FIG. 6 traveling over the ground surface 12 in the direction indicated by the arrow 14, and the paving apparatus 110 of the present invention incorporates many of the components of the conventional paving apparatus 10 illustrated in FIG. 2. Nonetheless, for ease in understanding the present invention, an abbreviated description of those elements is presented with specific reference to FIG. 6.

The paving apparatus 110 comprises a main frame 20 supported substantially horizontally on a single front ground engaging member 22, which is steerable, and a pair of rear ground engaging members 22. The engaging members 22, which are preferably endless track crawler assemblies, are mounted to the main frame 20 in a triangular relation to each other to provide stable suspension of the frame 20 in a substantially horizontal position above the ground surface 12. An engine 24 and a hydraulic pump (not shown) are mounted on the frame 20 to provide drive power to at least one ground engaging member 22 and to supply operational power to the various paver systems. The driven ground engaging member or members are preferably driven through individual, preferably reversible, hydraulic motors, thereby making the paving apparatus 110 operable while traveling in the forward or in the reverse direction.

The paving apparatus 110 includes an operator station 26 in which the operator of the paving apparatus 110 is positioned and may monitor and control the paving apparatus 110 using a control console 28. The control console 28 is part of a control system 130 for the paving apparatus 110; a block diagram illustrating some of the basic components of an exemplary control system 130 for the paving apparatus 110 is presented in FIG. 7. As shown therein, the control system 130 further includes operational controls 140 for directing the various operational components of the paving apparatus 110, a receiver facility 132 for receiving data from the robotic base station 120, and the machine controller 150 for processing the data and interfacing with the control console 28 and operational controls 140. Many of these components are described in greater detail hereinbelow.

As will be understood, the ground surface 12 on which the paving structure 40 is to be laid in molded form is prepared in advance by suitable construction grading equipment. However, the paving apparatus 110 may be equipped with a trimming station 30 in order to provide a finished grade of the ground surface 12 immediately in advance of the paving operation. The structure of such a trimming station 30 may include a rotatively driven roller having digging teeth projecting from its outer periphery for the purpose of partially digging into the ground surface to loosen and uniformly distribute the soil on which the pavement is to be formed. The trimming station 30 may additionally include a scraper blade extending transversely across the rear side of the digging roller to level the loosened soil. The trimming station 30 may be of the type described and illustrated in U.S. Pat. No. 4,808,026 to Clarke, Jr. et al. or U.S. Pat. No. 4,197,032 to Miller.

A mold 32 having a desired cross sectional shape corresponding to the cross sectional shape of the structure to be formed is supported by the frame 20. The mold 32 is located rearwardly of the trimming station 30 if such a trimming station 30 is installed on the paving apparatus 110. In FIG. 6, a mold 32 in the shape of a curb and gutter structure is illustrated and the mold 32 is positioned on one side of the paving apparatus 110 to facilitate continuous slip forming of a concrete curb and gutter such as are typically formed along the sides of a roadway during road construction. It should be understood, however, that the paving apparatus 110 is capable of continually depositing concrete or other flowable paving material 38 in a variety of different predetermined cross sectional shapes defined by a variety of different mold structures transported at a variety of different positions on the paving apparatus 110. Hence, it should be understood that the illustrated apparatus 110 is not limited to curb paving machines but is equally applicable to machines for slip forming roadways, gutters, spillways, sidewalks, troughs, barriers, and any other form of continuous paving extrusion.

The paving apparatus 110 also includes a hopper 34 and a conveyor 36. Together, the conveyor 36 and hopper 34 are adapted to receive the concrete or other flowable paving material 38 from a separate paving material supply (not shown) and convey the flowable paving material 38 to the mold 32. As is known in the art, means for vibrating the flowable paving material 38 may be provided on the paving apparatus 110 to eliminate air bubbles and facilitate flow of paving material 38 into the mold 32. Flowable paving material 38 is continuously supplied to the mold 32 such that a continuous paving structure 40 is formed on the ground surface 12 as the paving apparatus 110 moves along the ground.

The main frame 20 of the paving apparatus 110 is supported on the ground engaging members 22 by a plurality of posts, which are independently extendable or retractable to vary the position of the main frame 20 with respect to the ground engaging members 22. Because the mold 32 is also supported by the main frame 20, changing the position of the frame 20 changes the position of the mold 32 as well. The posts may be threaded posts that are rotated by associated reversible hydraulic motors or, alternatively, the posts may be operated by hydraulic piston-cylinder mechanisms 52,54,56. Three such piston-cylinder mechanisms are illustrated in FIG. 6, including a front grade piston-cylinder mechanism 52, a rear grade piston-cylinder mechanism 54, and a slope piston-cylinder mechanism 56. In addition to extending or retracting in a generally vertical direction, it should be understood that the front grade piston-cylinder mechanism 52 illustrated in FIG. 6 is supported by a ground engaging member 22 that includes a hydraulically operated steering mechanism, which may be a piston-cylinder mechanism or a hydraulically operated threaded post mechanism, that rotates the ground engaging member 22 relative to the front grade piston-cylinder mechanism 52 to thereby steer the paving apparatus 110.

Returning to FIG. 7, an exemplary machine controller 150 includes RAM 152, ROM 153, a clock 154, a central processing unit (CPU) 155, an analog-to-digital converter 156, a digital-to-analog converter 157, and an input/output control unit 158 integral to the machine controller 150. Each component is electrically connected to the CPU 155. Control system program instructions are stored in ROM 153 and executed by the CPU 155, which uses RAM 152 to temporarily store data during machine controller operations. An integral clock 154 provides a timing reference for the control system 130 and converters 156, 157 are used to convert analog data from various sensors to digital data for computation of the required offsets, and then back into analog data for the various outputs.

Figure 7:
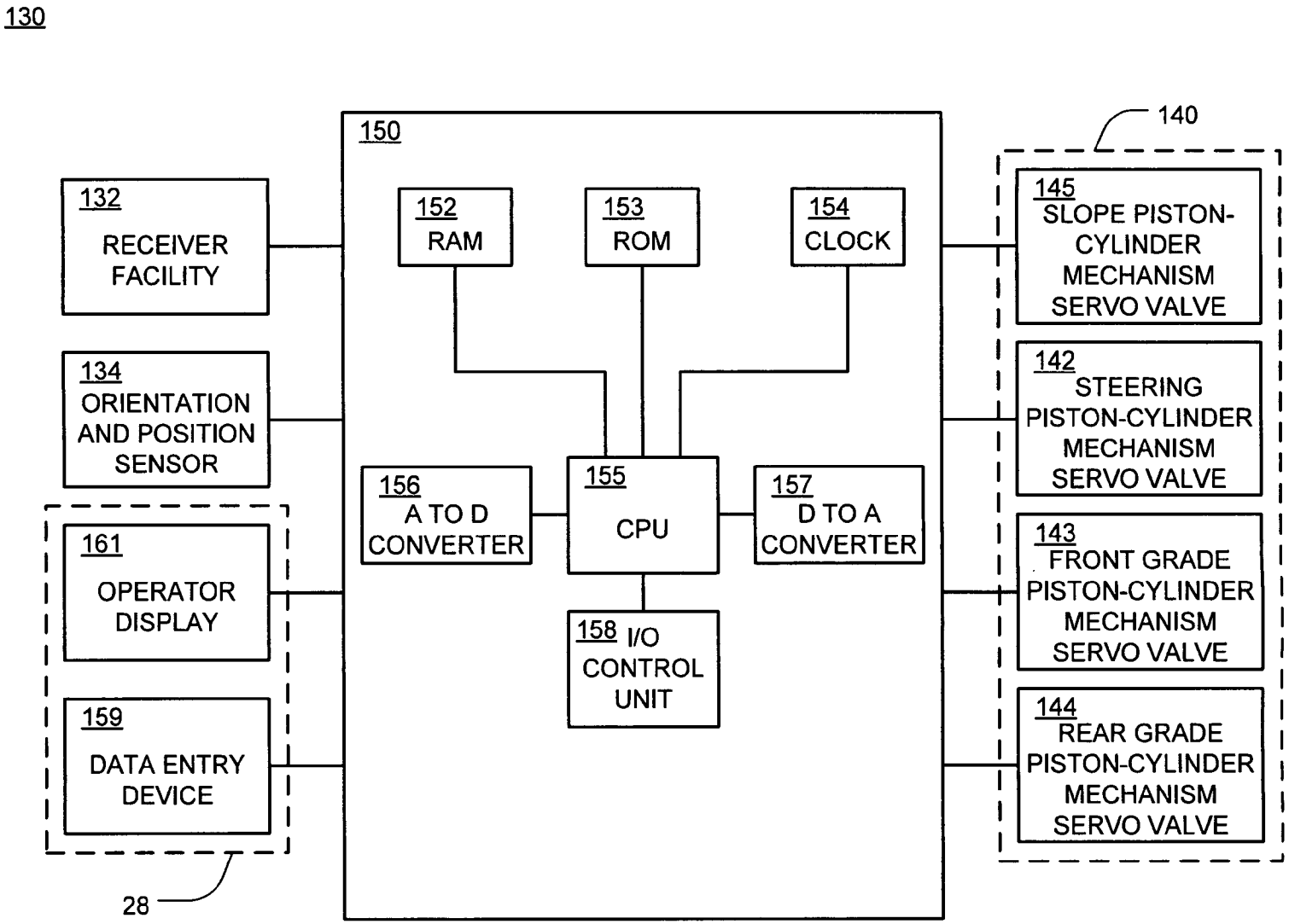
FIG. 7 is a block diagram illustrating some of the basic components of the paving apparatus control system.

It should be understood that, while ROM 153 is illustrated in FIG. 7, those in the art will readily appreciate that program instructions may be stored on other devices, such as, but not limited to, an EPROM. The input/output control unit 158 is used to control data moving in and out of the machine controller 150.

Those skilled in the art will appreciate that the functions performed by the machine controller 150 of the present invention may readily be performed by other equivalent electrical devices or circuits, which are intended to be included within the scope of the present invention. For example, in lieu of using a machine controller 150, a control system may utilize a conventional microprocessor-based personal computer to accomplish functions performed by the machine controller 150. Additionally, in lieu of using integral processors executing stored program codes, discrete electrical components may be arranged in an electrical circuit to accomplish the same functions as the machine controller 150, as those in the art will readily appreciate that a circuit comprising discrete electrical components may receive input signals, performed calculations, and output values to output devices. These circuits are also included within the scope of the present invention.

The operational controls 140 of the control system 130 include a plurality of output devices, including a steering piston-cylinder mechanism servo valve 142 controlling the direction of movement of the steerable ground engaging member 22, a front grade piston-cylinder mechanism servo valve 143 controlling the elevation of the front grade piston-cylinder mechanism 52, a rear grade piston-cylinder mechanism servo valve 144 controlling the elevation of the rear grade piston-cylinder mechanism 54, and a slope piston-cylinder mechanism servo valve 145 controlling the elevation of the slope piston-cylinder mechanism 56. Additionally, output data from the machine controller 150 is sent to an operator display 161, which is typically located on the control console 28, and a data entry device 159 such as a keypad or keyboard, also usually located on the control console 28, provides input data to the machine controller 150 entered from an operator. Steering servo valves suitable for use in the present invention are widely available.

Unlike the conventional paving apparatus 10, the paving apparatus 110 of the present invention does not require or include steer, grade or slope sensors 42,46,48,49. For guidance, the paving apparatus 110 of the present invention instead includes the rotating mobile unit assembly 101, mounted thereon, having a mobile unit 102 for interaction with the robotic station 120 shown in FIG. 4, and the machine controller 150 shown in FIG. 7 for receiving positional data from the robotic station 120 and making calculations to determine the position and orientation of the apparatus 110 and thereby control its operation. As described previously, the mobile unit 102 will generally be described herein as a prism, but it will be appreciated that another type of geodetic or other location-determination device, such as a GPS device, may be substituted therefor. Machine controllers for performing calculations to determine the position of a prism and using that information to control the operation of a piece of construction equipment are well known. However, the machine controller 150 of the present invention varies from a conventional controller in that it is equipped to perform an additional layer of determinations and calculations, or may perform a replacement set of determinations and calculations, to derive positional and orientational information as described in detail hereinbelow. In this regard, it will be appreciated by the Ordinary Artisan that the machine controller 150 shown in FIG. 7 may further include a separate device or set of devices (not shown) to perform such determinations and calculations, or it may include additional programming to handle such functionality.

The rotating mobile unit assembly 101 includes a mobile unit 102, such as a "3D" optical prism or other device, mounted at the end of a support arm 103. A counterweight 104 may be disposed at the other end of the support arm 103, and the entire arrangement is supported on a spindle 105 such that the prism 102 rotates about an axis 107 defined by the spindle 105. The length of the support arm 103 is not critical so long as the prism 102 is offset from the axis 107 around which it rotates by a sufficient distance to provide accurate readings, as described below. In particular, the radius of revolution can be small. A larger radius will provide more accurate results, but because of the accuracy of robotic station measurements, even a 3-inch radius could provide data more accurate than conventional purpose-made slope sensors because of the greater accuracy of directional data as compared to the time-based-position calculations used by such conventional sensors. The mobile unit assembly 101 is preferably disposed in a location that minimizes line-of-sight obstructions between the prism 102 and the robotic station 120, such as on top of the engine 24.

The mobile unit assembly 101 further includes a gear motor (not shown) for causing rotation of the support arm 103 around the axis 107. The support arm 103 may be directly or indirectly mounted to the motor. The mobile unit assembly 101 also preferably includes a sensor 134, shown schematically in FIG. 7, for determining angular orientation of the support arm 103, and hence the prism 102, about the axis 107 at any given moment. The sensor 134 is preferably a rotary encoder mounted to the rotating support arm 103, but other types of sensors may be substituted. If a rotary encoder is utilized, a relative position encoder with a single index output is sufficient. The importance of the angular orientation information will be made clear below.

Figure 8A:
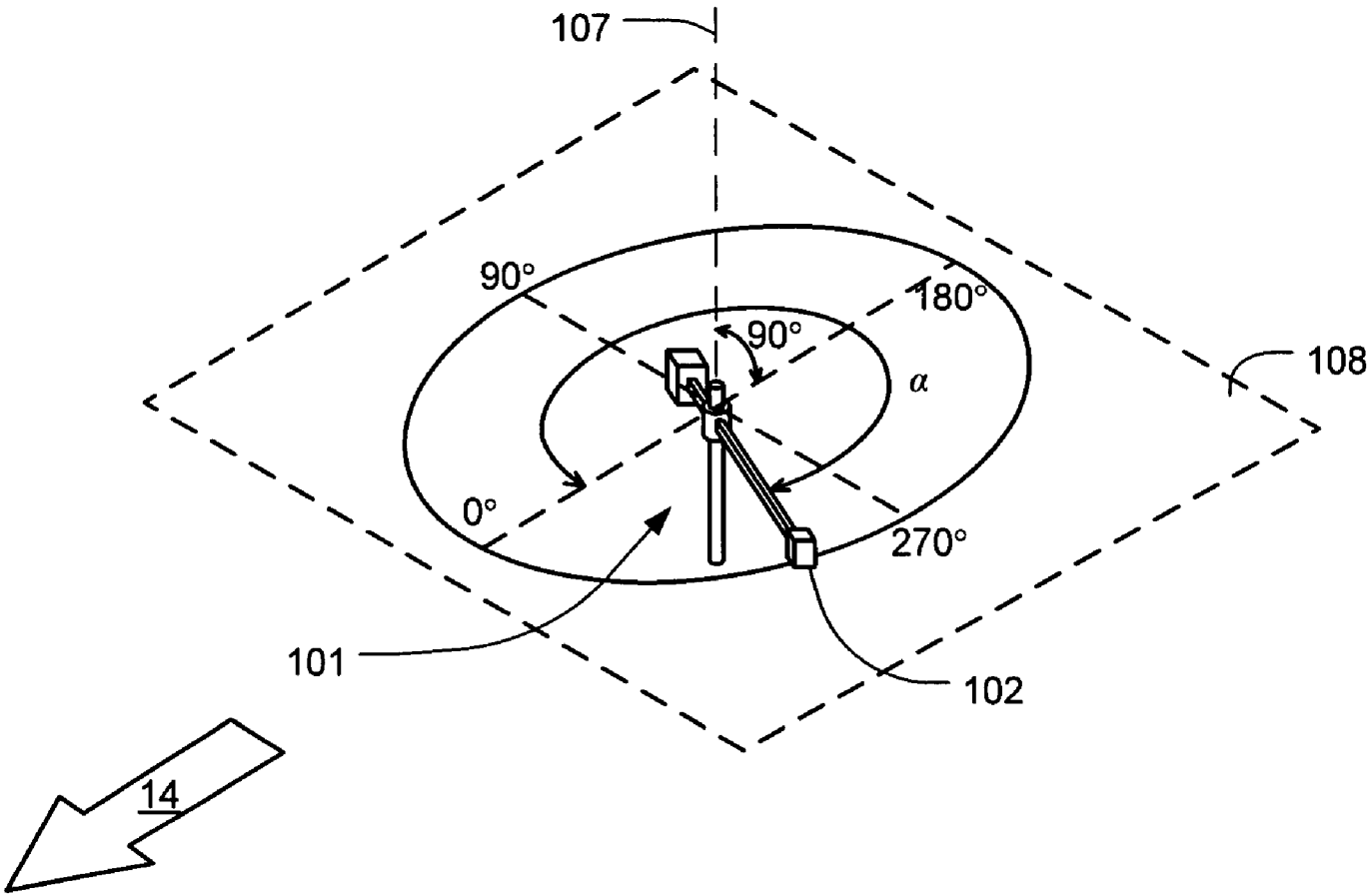
FIG. 8A is a schematic representation of the rotation of the prism.

The prism 102 may be of conventional design, in that it may be any optical device capable of reflecting light, such as a laser beam, directly back to the robotic station 120 or other source, and of having its position determined with great accuracy (less than one-eighth of an inch using currently-available equipment). Unlike conventional technology, however, the prism 102 is continuously rotated about the axis 107 defined by the spindle 105. FIG. 8A is a schematic representation of the rotation of the prism 102. As shown therein, the rotation of the prism 102 occurs in a plane 108 defined as perpendicular to the axis 107. Notably, the plane need not be perfectly horizontal, as long as a substantial portion of the movement of the prism 102 occurs in the x- and y-directions.

The robotic station 120 continues to track the prism 102 during its rotation. During each revolution of the prism 102 about the axis 107, the robotic station 120 gathers data on the position of the prism 102 at least twice and more preferably about three times. This process of gathering this data occurs generally conventionally, in that the robotic station controller 124 uses the robotic controls 122 to direct a laser 121 at the prism 102 to determine the distance and angle from the robotic station 120 to the prism 102, and uses the transmission facilities 123 to transmit that positional data as well as GPS data from the GPS system 125, to the paving apparatus control system 130.

It will be appreciated that the positional data the robotic station 120 gathers about the location of the prism 102 may be in any of a variety of forms, such as XYZ data, angular data, or the like. Whatever form is selected, it will be necessary, of course, for the paving apparatus control system 130 to receive the data in the expected form. However, it will be apparent that any of a variety of data forms may be utilized without departing from the scope of the present invention.

Automated 3D Control of Paving Operations

Each time the robotic station 120 gathers information about the location of the prism 102, the orientation sensor 134 determines the angular orientation a of the prism 102 about the axis 107 and provides this angular orientation data to the machine controller 150. If needed, the machine controller 150 can readily calculate the angular velocity, and any position, using encoder counts and time, regardless of the motor speed. Meanwhile, the positional data determined by the robotic station 120, including the GPS data for the robotic station 120 and the instantaneous relative positional data for the prism 102, is transmitted to the receiver facility 132 of the machine control system 130 and relayed to the machine controller 150, where it is coupled with the angular orientation data. Using all of this data, the machine controller 150 triangulates to determine the precise instantaneous location of the prism 102 at the time the respective data was gathered.

Figure 8B:
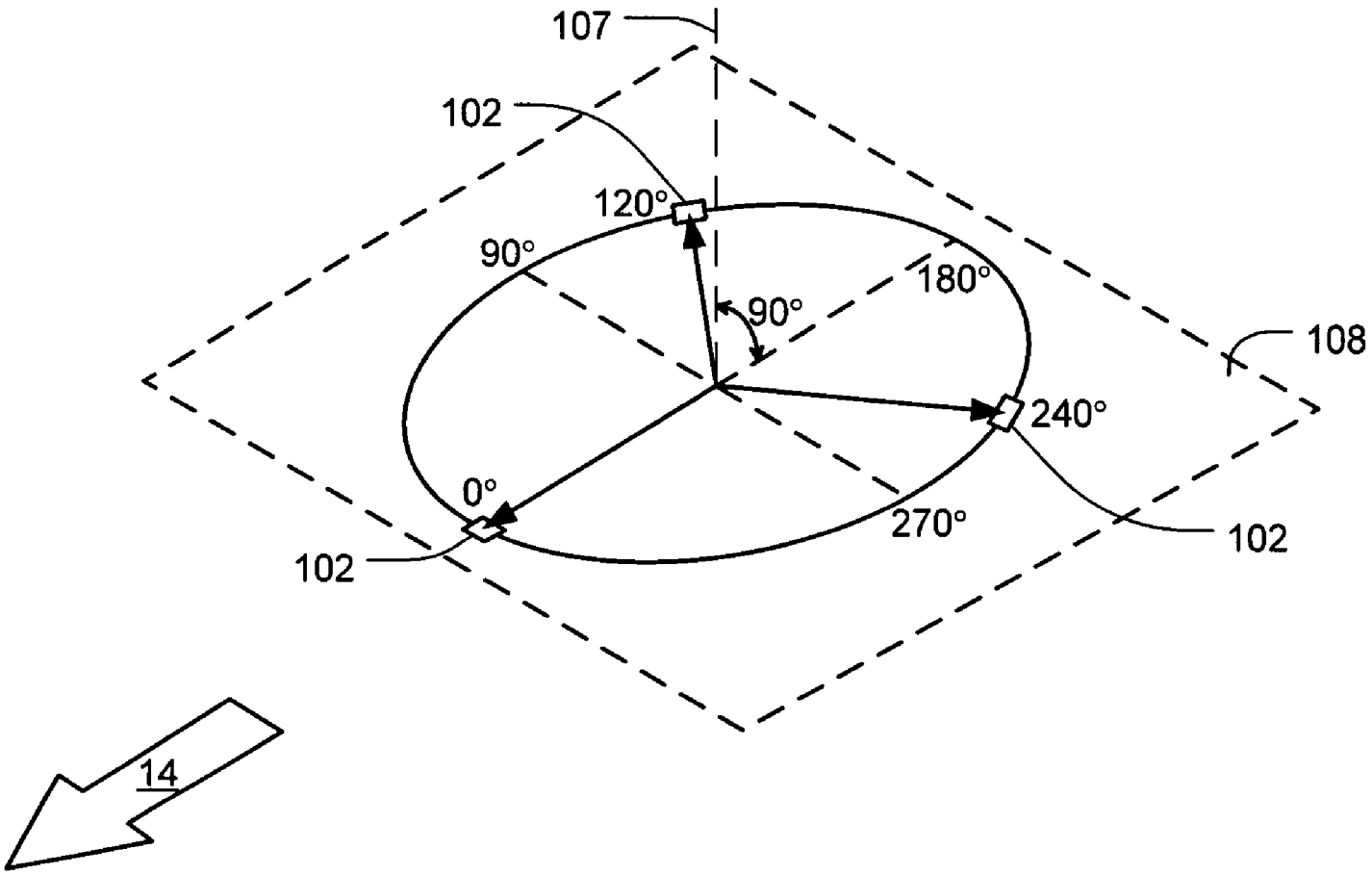
FIGS. 8B and 8C are schematic representations of the use of multiple positional measurements to determine direction, position and orientation of the paving apparatus.

FIG. 8B is a schematic representation of the use of multiple positional measurements to determine direction, position and orientation of the paving apparatus 110. Because the rotational speed of the prism 102 is known, repeated measurements or determinations of the position of the prism 102 may be used to derive information about the movement of the paving apparatus 110. By revolving the prism 102 and measuring two instantaneous positions at known angles about the axis 107, a vector representative of the direction of movement 14 of the paving apparatus 110 may be obtained. By revolving the prism 102 and measuring three positions at known angles about the axis 107, the plane in which the prism 102 rotates may be determined. Because the plane is fixed relative to the paving apparatus 110, the three points may be triangulated to determine the position and orientation of the paving apparatus 110 in space, with the development of the mathematical equations used for such determination being within the skill of the Ordinary Artisan.

In at least some embodiments, the robotic station controller 124 receives position data exactly three times during each revolution, at rotational increments that are exactly 120 degrees apart, as shown in FIG. 8B. However, readings that are recorded at irregular increments will be sufficient as the machine controller 150 of the paving apparatus 110 will be triangulating the angular position of the revolving prism 102 using the data sent by the robotic station 120. Furthermore, additional readings (such as ⅙ revolution) may be taken and averaged to verify or improve upon the data transmitted from the robotic station 120. At any time, increasing the number angular position readings can increase accuracy by averaging these redundant measurements.

Automatic paving operations may be conducted using the rotating mobile unit assembly 101, front ground engaging member 22 and piston-cylinder mechanisms 52,54,56 described above. After the paving apparatus 110 is correctly positioned relative to the intended location of the paving structure 40, paving apparatus 110 travel and paving operations may commence. When deviations from the desired horizontal direction of paving apparatus 110 travel are detected by the machine controller 150, the controller generates an output signal used to operate a steering piston-cylinder mechanism servo valve 142, which directs hydraulic fluid to the appropriate port on the steering mechanism in order to turn the steerable ground engaging member 22 in the desired direction.

Similarly, deviations from the desired vertical direction of the main frame 20 relative to the intended location of the paving structure 40 are detected by the machine controller 150, the controller generates one or more output signals used to control the servo valves 143,144 associated with the front grade piston-cylinder mechanism 52 and the rear grade piston-cylinder mechanism 54, respectively. The piston-cylinder servo valves 143,144 control extension or retraction of their associated piston-cylinder mechanisms 52,54 to return the frame 20 to its desired position relative to the intended location of the paving structure 40. Significantly, the accuracy of long slope adjustments can be greatly improved as compared to the accuracy of current purpose-made slope sensors.

Automated 3D Control of Adjustable Cross Slope

As will be appreciated by those skilled in the art after reading the discussion above, the control system 130 of the present invention advantageously provides for a mold position on a paving apparatus 110 that maintains a relative position true to the desired location of the paving structure 40 as the paving apparatus 110 travels along the ground 12. The present invention may be advantageously utilized to automatically form a paving structure 40 having a variable cross slope relative to the ground upon which the structure is laid, all without the need for a string line 16. As described below, an operator may enter a desired cross slope at any time during operation of the paving apparatus 110 and the automatic control system 130 of the present invention will adjust the slope piston-cylinder mechanism 56 accordingly to insure that the predetermined reference point on the mold position remains constant relative to the desired location of the paving structure 40 while the mold 32 transitions between cross slopes.

Figure 9:
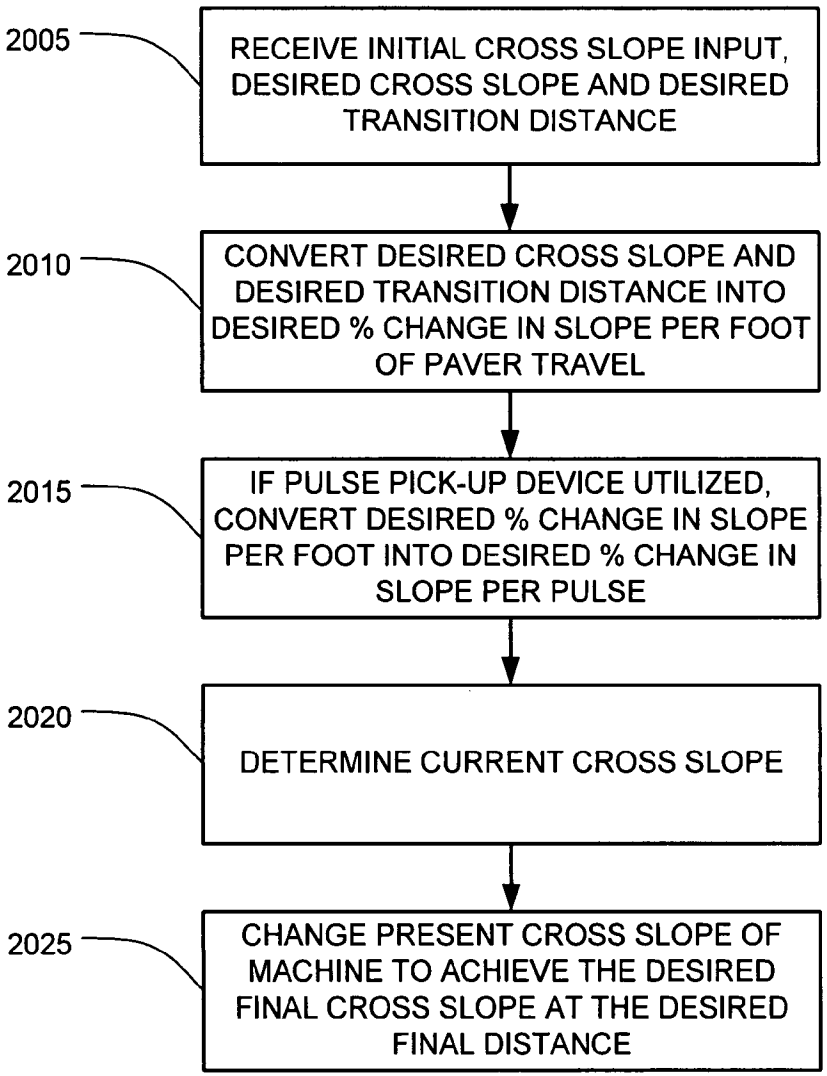
FIG. 9 is a flow chart illustrating the steps performed by the control system in transitioning cross slope over a given distance.

FIG. 9 is a flow chart illustrating the steps performed by the control system 130 and more particularly by the machine controller 150 in transitioning cross slope over a given distance. In step 2005, the machine controller 150 receives initial cross slope input as an output of the process described above as well as the desired altered cross slope and desired transition distance, which are preferably provided as part of the site data but may alternatively be entered or downloaded manually by an operator using the data entry device 159. Whether provided automatically or manually, the latter values would typically be received as a percentage final slope over a given distance expressed in feet.

The desired altered cross slope and desired transition distance are converted into a desired percent change in cross slope per foot of paving apparatus travel by the machine controller 150 in step 2010. If a pulse pick-up device is utilized, this value is then converted into a desired percent change in cross slope per pulse of the pulse pick-up device in step 2015. This conversion is possible because the distance of paving apparatus 110 travel per pulse and therefore the number of pulses per foot of paving apparatus 110 travel is known for a given pulse pick-up device.

In step 2020, the machine controller 150 determines the current cross slope and in step 2025, the machine controller changes the present cross slope of the paving apparatus 110 based on the location or distance-of-travel input derived by the machine controller 150 or received from the pulse pick-up device at a rate necessary to achieve the desired altered cross slope over the desired distance. This process may be periodically performed as the paving apparatus 110 travels and successful results have been achieved in the present invention performing the above process 200 times per second. A particular advantage of the control system 130 of the present invention is that an operator may change the desired altered mold cross slope or the desired transition distance at any time during a cross slope transition without affecting the present cross slope of the paving apparatus. During transition, the control system 130 of the present invention is also performing the vertical and steering adjustments, as previously discussed, in order to ensure that the predetermined reference point on the mold 32 maintains a substantially constant position relative to the desired location of the paving structure 40 during mold cross slope transition.

As demonstrated by the above discussion, the present invention advantageously allows for the automatic molding of continuous paving structures 40 having a variable cross slope without the need for a string line 16 while maintaining the position of the mold 32 substantially constant relative to the desired location of the paving structure 40 as the paving apparatus 110 travels. The present invention also automatically maintains a substantially constant position of the mold 32 relative to the desired location of the paving structure 40 during transition from an initial mold cross slope to an altered mold cross slope over a given transition distance, also advantageously without the need for a string line 16. Perhaps most significantly, the accuracy of cross slope adjustments, like those for long slope, can be greatly improved as compared to the accuracy of current purpose-made slope sensors.

Method of Continuously Determining a 3D plane and Coordinate System

The information determined as described above may be used by the system 100 to derive or translate the position and orientation of the paving apparatus 110 in any desired, predetermined x-y-z coordinate system. In some embodiments, for example, the x-y-z coordinates may correspond to those of a construction site as a whole, wherein the x coordinate could defined as extending directly north or south, the y coordinate could be defined as extending directly east or west, and the z coordinate could be defined as extending directly up or down. In other embodiments, the x-y-z coordinates may be defined relative to the paving apparatus 110 itself, wherein the x coordinate could be defined as extending directly forward and backward from the paving apparatus 110, the y coordinate could be defined as extending directly to the right and left of the paving apparatus 110, and the z coordinate could be defined as either extending vertically above and below the paving apparatus 110 or extending perpendicularly upward and downward relative to the x and y coordinates. In these embodiments, the zero point along each coordinate axis may be defined at any desired point, but it may be useful in some of these embodiments to define it at some physical point in the paving apparatus 110, with the "+" and "−" directions defined appropriately.

Also, it should be noted that although the process described hereinabove may be used to derive the position and orientation of the paving apparatus 110 in the x and y coordinates, it may be necessary to provide some manual input to the system as to the "+" and −" orientation of the z coordinate. Alternatively, it could be assumed that the "+" direction is upward and the "−" direction is downward.

Notably, the position and orientation of the paving apparatus 110 may be determined regardless of whether the apparatus is moving or not. If the paving apparatus 110 is stationary, then the three positions at which measurements or determinations are made during each revolution are sufficient to define a circle that lies in the plane and whose center is on the axis 107. If the paving apparatus 110 is moving, then the circular or elliptical figure defined by the three positions varies from a true circle in an amount proportional to the amount of movement of the paving apparatus 110.

Speed Control of the Rotating Mobile Unit Assembly

The gear motor does not need to be closely speed-controlled as the robotic station controller 124 is simply gathering and relaying three readings that are preferably ⅓ revolution apart. The exact speed with which the rotation occurs is not critical, but certain parameters are preferably observed. The speed of the gear motor should be slow enough so as to not overwork the robotic station 120 but fast enough to provide directional data as quickly as the machine controller 150 of the paving apparatus 110 needs it. The machine controller 150 will always know the position of the paving apparatus 110 even if the revolve speed is zero because it will always know the angular position of the prism 102 and the angular position of the prism 102 relative to the paving apparatus 110. However, in order to provide orientation data, the revolve speed must be increased from zero. It is anticipated that in the preferred embodiment of the present invention, rotational speed should be between 0 RPM and 60 RPM.

Although it may appear that the revolution of the prism 102 would increase the movement of the tracking portion of the robotic station 120, rotational speed can be modulated so that the tracking portion of the robotic station 120 actually shifts more slowly than if the prism 102 does not revolve. This can be achieved if the rotational speed of the prism 102 is made slower than the ground speed of the paving apparatus 110, all relative to the location of the robotic station 120.

Figure 8C:
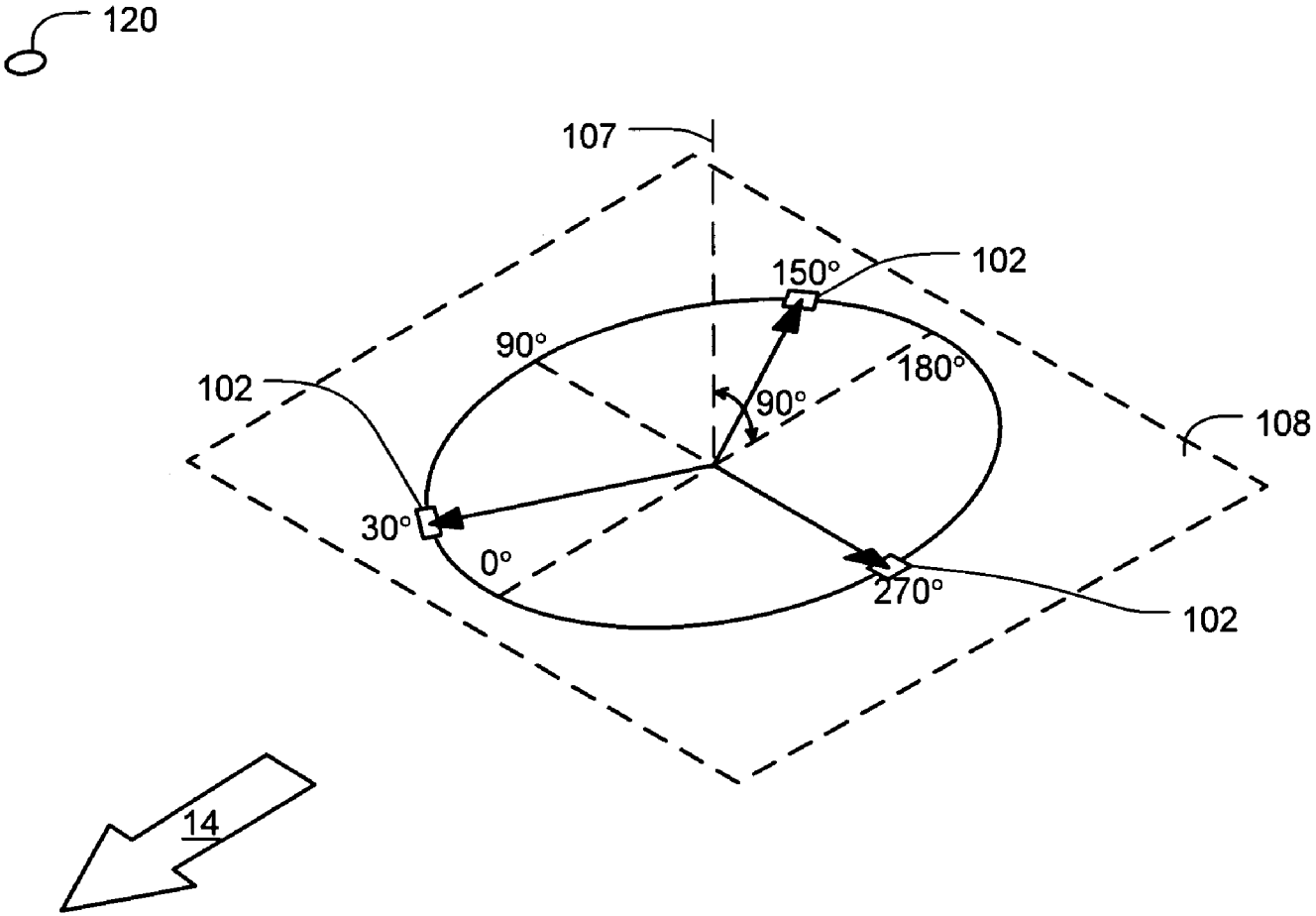

In at least some embodiments, this is further refined by incorporating the general position of the robotic station 120 relative to the paving apparatus 110. For example, as shown in FIG. 8B, if the forward direction 14 of the paving apparatus 110 is defined as 0 degrees, the direction perpendicularly to the right of the paving apparatus 110 is defined as 90 degrees, and so on, then it might be assumed that when the rotation of the prism 102 is in the clockwise direction (as viewed from above), the three readings should be taken when the prism 102 is at angular orientations of 0, 120 and 240 degrees, respectively. However, if it is known that the robotic station 120 is located generally in the 90 degree direction (i.e., directly to the right of the paving apparatus 110), then the optimal readings would be taken at angular orientations of approximately 30, 150 and 270 degrees, respectively, as shown schematically in FIG. 8C. This helps reduce the amount of movement of the robotic station 120 because the movement of the prism 102 caused by the forward movement of the paving apparatus 110 is counterbalanced by the rearward movement of the prism 102 caused by the clockwise rotation of the mobile unit assembly 101. In other words, the actual position of the prism 102 changes little from the 30 degree reading to the 150 degree reading, thereby minimizing the amount of movement required of the robotic station 120 to track it.

Initially, triangulation calculations are preferably performed only after the third measurement, which in the previous example would be the measurement taken at the angular orientation of 180 degrees. However, after the first three readings are taken, triangulation is preferably refined on an ongoing basis. The machine controller 150 need not wait for three new readings before making a new triangulation calculation; instead, once the first three readings are taken, the triangulation can occur after every reading. In other words, rather than make triangulation calculations only after the third reading, the sixth reading, the ninth reading, the twelfth reading, the fifteenth reading, and so on, triangulation calculations may be made after the third reading, the fourth reading, the fifth reading, the sixth reading, and so on. This further reduces the need for high revolution speeds.

Data Interruptions & Lag Time

The use of averaging or ongoing refinement also helps to address issues caused by interruptions or delays in receiving data from the robotic station 120. Ideally, the robotic station 120 would take a reading, transmit the data and the machine controller 150 would receive the data and know the angular position of the revolving prism 102, all at the same instant in time. Time for triangulation calculations can be done afterwards.

However, because interruptions or delays in data from the robotic station 120 can occur on jobsites, at least some embodiments of the present invention include features and aspects at least partially intended to address such occurrences. Some delay, often referred to as "lag time," may be inherent in the system, since the machine controller 150 is likely to receive the angular position data directly from the rotary encoder 134 a significant period of time before the locational data is received from the robotic station 120. Other interruptions and delays may stem from line of sight interruptions, such as may be caused by someone walking between the prism 102 and the robotic station 120, data transmission interference, lag time between the data signal received and the actual position of the paving apparatus 110 or other steerable construction machine, or the like. During an interruption, the machine controller 150 will typically allow a short period of time to pass as the controller 150 simply locks the operational controls 140; the paving apparatus 110 may continue to advance, but no height, steering, or other corrections will be made. A longer time period will halt the machine 110 altogether.

Additionally, if the signal from the robotic station 120 is interrupted or delayed, in at least some embodiments there will be less need to wait for three new points, because previous readings may be used to infer current conditions, at least for a time, until the signal from the robotic station 120 resumes. Other aspects and features for dealing with the interruption or delay of signals from the robotic station 120 are described below.

These problems may be addressed as follows. For delays due primarily or entirely to lag time, it will be recognized that some amount of error due to data lag may be acceptable. First, data lag is inherent to current 3D controllers that are already operating with sufficient accuracy. In addition, triangulating position and orientation from multiple (revolving) points will inherently average the measurement, thereby reducing overall error. Further, since the revolving prism 102 moves relatively slowly, compared to the update frequency of the robotic station 120, revolution angular error will not cause a significant error in machine orientation.

On the other hand, more significant delays may be addressed as follows. As a preliminary matter, it will be understood that the machine controller 150 essentially always knows the angular (revolved) position of the prism 102 more or less instantaneously. Thus, the critical time period is from the time that the robotic station 120 begins to calculate position until the time that the machine controller 150 receives the calculated position data from the robotic station 120. Depending on the amount of lag time or other delay that occurs, the location of the revolving prism 102 may have moved by the time the machine controller 150 fully receives the signal. That creates the difficulty of knowing what revolve angle the machine controller 150 should use in triangulation.

Depending on the circumstances, this problem may handled in one or more ways. If the time delay is inherent in the system, e.g., due to the robotic station calculations or due to time to transmit data, then the robotic station controller 124 could send a short burst of data, such as a unique checksum, to the machine controller 150 to indicate that the current revolve position corresponds to the position of the forthcoming data. The robotic station controller 124 would also likely need to include a checksum at the end of the data transmission to verify data integrity.

In at least some embodiments, the machine controller 150 could assume there is no time lag, i.e, the machine controller 150 could ignore the effects of time lag altogether. The actual position of the prism 102 is constantly being triangulated to find the center point of rotation. Thus, assuming for example that prism measurements are being made during each revolution at angular rotations of 0, 120 and 240 degrees, any time lag error at a 0 degree reading will be equally offset by the time lag error at the 120 and 240 degree readings and each additional reading. Therefore the center point of rotation will only experience an error due to variations in average time lag. Because this is an averaged error, the error should be relatively small; for example, it should be much smaller than the error already inherent to 3D control systems. Furthermore, time-based position calculations, already being used in conventional machine controls, can be used to correct and predict time lag errors in direction. For example, if readings are believed to be occurring at angular rotations of 0, 120 and 240 degrees, but due to time lag are actually occurring at 5, 125 and 245 degrees, then a false machine direction will be indicated, but can be corrected by the actual time based-position of the construction machine 110. As to long slope and cross slope orientation, misreading an angular rotation by 10 degrees would be inconsequential to the relative height accuracy in those directions. In this regard, it will be appreciated that such an error applies to the direction of the slope and not to the actual magnitude of slope, where the inaccuracy is essentially negligible.

This is illustrated in FIGS. 10A and 10B, which are a top plan view and a side plan view, respectively, of a paving apparatus 110 whose direction of travel 14 is being accurately determined, and FIGS. 11A and 11B, which are a top plan view and a side plan view, respectively, of a paving apparatus 110 whose actual direction of travel 14 is being inaccurately determined. In FIG. 10A, the paving apparatus 110 is shown traveling straight ahead as shown by arrow 14. However, as shown in FIG. 10B, the paving apparatus 110 is encountering a cross slope denoted as θ. If, as shown, the center-to-center distance between the ground engaging members 22 is 75 inches, and the cross slope is 2°, then one of the ground engaging members 22 is adjusted vertically in an amount calculated as:

$$x=75''\times\sin 2^\circ=2.617''$$

In FIG. 11A, however, a 10° lag has been introduced, thus causing the perceived direction of travel, shown by arrow 15, to be 10° different than the actual direction of travel 14. In this case, the distance between the ground engaging members 22, measured in a direction normal to that of the actual direction of travel 14, may be calculated as:

$$z=75''\times\cos 2^\circ=73.861''$$

and thus the vertical adjustment of the ground engaging member 22 is calculated as:

$$w=73.861''\times\sin 2^\circ=2.577''$$

The inaccuracy thus introduced (2.617"−2.577"=0.040", equivalent to a slope error of 0.03° or 0.006" per foot) is thus very small.

If the time lag is consistent, the machine controller 150 can predict or post-predict what the revolve angle will be when a reading will be taken based on a calculated revolve velocity. The revolve velocity can be calculated based on a read encoder signal rate versus time.

On the other hand, if lag time is highly variable, then an additional machine control algorithm may be implemented. The machine controller 150 can measure the start time and end time of any successful transmission and then post-predict the correct revolve angle. The assumption here is that the data received from the robotic station 120 represents the position of the prism 102 at either the start or end of transmission or at a consistent time between the start and end. Time between start and ending transmission may be averaged and weighted for improved accuracy. Any non-successful data transmission can be ignored. Interrupted data can be prevented from disrupting the averaging as the machine controller 150 can sense and compensate if it does not receive a data packet within a predetermined increment, e.g., within any ⅓ revolution increment if three readings are being made each revolution.

Coordination of readings by the robotic station 120 with the corresponding revolve angles could be achieved if the machine controller 150 could broadcast the current revolve angle for receipt by the robotic station 120. The robotic station 120 could use that data to return machine position data to the machine controller 150 along with long and cross slope position data. However, this may not help time lag problems and probably requires a non-standard robotic station.

Inconsistent lag time could be due to the robotic station 120 using a large portion of its cycle time concurrently reading, calculating, and sending data instead of providing a snapshot of relative XYZ position data. For example, inconsistent or unnecessary lag time may result if 80% of the cycle time of the robotic station 120 is used to acquire the relative XYZ position data instead of using 20% of the cycle time to capture a snapshot of relative XYZ position data and using the remaining 80% of the cycle for post processing and transmission time. When so much of the cycle time of the robotic station 120 is used to acquire the data, position-vs-time could be difficult to correlate. If this is the case, a different approach is to displace as much data processing as possible from the robotic station 120 to the machine controller 150. Although the machine controller 150 would have to perform additional calculations, it would have all of the raw data available with a time stamp, making it possible to more accurately correlate the positional data with the revolve angle data. Further, the robotic station 120 could send incremental data (e.g., first sending X, then Y, then Z); the revolve angle could be sampled at or before each transmission of incremental data. The data could also be sent at a slower rate such that more exact timing may be applied. Any of these methods along with a combination of the previously described methods can be implemented to achieve the highest possible update rate.

Furthermore, if lag time remains inconsistent to a degree that the an angular revolve position can not be accurately correlated for steering purposes, then the machine controller 150 can resort to using a time-vs-position steering correction, wherein the machine's current location is compared to its previous location and appropriate steering correction is made. Furthermore, the revolving prism 102 could repeatedly revolve ⅓ revolution, stop, wait for the receipt of accurate data, and then repeat. Although this may be a less desirable method, as the steering will only be as accurate as conventional methods, long slope and cross slope data will still be available, albeit at a limited update rate. Slow moving, stop-and-go, low tolerance, or handheld devices will still benefit from this method of finding orientation.

Installation Setup and Calibration

One significant advantage of the system 100 of the present invention is the ease with which the rotating mobile unit assembly 101 may be located and installed on a paving apparatus 110 or other construction machine. On paving, curbing, and other steerable construction machines, selecting the location of a conventional prism or other mobile unit is more of an art than a science. Conventional 3D control systems require the prism to be mounted in a position most favorable to the dynamics of the paving apparatus 110 or other construction machine. The selected position is critical because the machine is controlled on the basis of that single point. Experience has shown that the single prism usually cannot be positioned directly above the mold reference point (or other control point) because the machine will be unstable when steering. Instead, the machine manufacturer or 3D controls installer must find the most effective "sweet spot" for the prism to be mounted. Differences between each 3D supplier, each machine manufacturer, and even each application for a given machine may require adjustment of the prism location. On the other hand, because of the exact location and orientation provided by the revolving prism, the actual mounting location of the rotating mobile unit assembly 101 will be relatively inconsequential, with one of the few limitations being that the sensor should preferably be mounted close to the mold reference point 60 to avoid environmental effects such as vibration.

Another significant advantage of the use of the rotating mobile unit assembly 101 is the reduced need for an accuracy in the setup and calibration process. Non-rotating prisms on construction equipment are conventionally calibrated as follows: the robotic station 120 is located and calibrated, the prism is rigidly mounted to the construction machine 110, the robotic station 120 locates the coordinates of the prism, at least three reference points are located on the construction machine 110 or device in order to locate the "to be guided" control point as well as the cross slope and long slope, the machine controller 150 (or robotic station 120) calculates the XYZ offset from the desired "to be guided" control point to the prism. The three reference points can be readily located using a small handheld prism that is manually oriented towards the robotic station 120 or by sighting through the telescope of the robotic station 120. Offset values may be entered when necessary. More than three points may be taken and averaged in order to reduce the human error of using the handheld prism or manual sighting. This entire calibration procedure reduces the need to exactly place the prism/sensor each and every time it is remounted. Once again, it will be appreciated that the location of the non-revolving prism will vary by individual application, machine manufacturer, and the supplier of the 3D equipment.

By contrast, because rotary encoders are inherently precision built devices, the rotating mobile unit assembly 101 as a whole can be a low precision device, with no need for close tolerance fabrication, assembly, or application. In particular, application to a steerable construction machine 110 will not require any precision in mounting or alignment of the prism 102; the radius of rotation is not as critical since it may be readily calculated using angular and XYZ data. Although ideally, the axis of rotation 107 would be aligned vertically (perpendicularly) with the x-y-z coordinate system of the machine, a calibration sequence along with the ongoing triangulation calculations described above will correct for any mounting deviations. Therefore, the axis of rotation 107 does not necessarily need to be oriented exactly parallel, square, or plumb to any reference.

After installation, the initial position and orientation of the revolving device will be read. A number of methods may be used to accomplish this, but in at least some embodiments, the following method could be used to record three (or more) points to define initial position and orientation. First, the prism 102 is rotated until it points towards the direction of forward travel 14 of the paving apparatus 110, and this first point location is recorded with the robotic station 120. This rotational angle may be defined as 0 degrees. Next, the prism 102 is rotated approximately 180 degrees (so that it points towards the reverse direction of the machine 110) and this second point location is recorded with the robotic station 120. Finally the prism 102 is rotated to any other rotational angle, but preferably halfway, between 0 and 180 degrees or between 180 and 360 degrees and this third point location is recorded with the robotic station 120. On a paving apparatus or other machine 110, the decision to record the third point between 0 and 180 degrees or between 180 and 360 degrees could determine either the left hand or right hand orientation of the machine 110. Only the first point and left/right hand machine orientation need to be known or set by the operator. Once this is accomplished and the mobile unit assembly 101 begins to revolve, the relative angular location of the encoder index mark of the sensor 134 will be found automatically as necessary.

If rigid and repeatable mounting is provided, and the machine controller 150 has stored the initial calibration, then the gear motor could simply be turned on and any three points can be recorded/calibrated without any user intervention. In this regard, storing the initial calibration may mean, for example, that the controller 150 knows the relative position of the encoder index mark versus the forward travel direction 14. Calibration of the revolving prism 102 is required only as often, or less, as would be required for a stationary prism, for example, when the prism 102 has been remounted or the prism mounts have shifted. Calibration of the revolving prism 102 will require no more work from the robotic station 120 nor from the machine/device operator than is required for a stationary prism. As described before, the machine operator will mount the revolving prism 102 at any convenient location and locate the three (or more) reference points that define the "to be guided" control point, cross slope, and long slope.

Additional Variations

In accordance with another preferred embodiment of the present invention, the rotating mobile assembly 101 could be replaced with an alternative mobile unit assembly that includes a mobile unit 102 whose movement occurs in some predictable pattern other than the circular movement described herein. Such movement could be elliptical, triangular, square, or the like, all as controlled by an X-Y translational device. Although the calculations performed to determine the position of the mobile unit 102 at each measurement point would be different, the basic principles of operation of the system 100 would otherwise remain the same.

In accordance with another preferred embodiment of the present invention, the fundamental components of the robotic station 120 and the prism 102 could be reversed. In other words, a robotic tracking station could be disposed on a rotating support arm on a paving apparatus 110 while a prism 102 is disposed in a fixed position.

In accordance with another preferred embodiment of the present invention, two or three static mobile units (not shown) could be used in place of the single rotating mobile unit 102, and repeated location determinations based on each of the mobile units could be used in place of the determinations based on the single rotating mobile unit 102. However, it will be appreciated that this may require the use of a separate robotic stations 120 for each static mobile unit 102, particularly if an optical (prism and total station) system is utilized.

In a further refinement of this approach, two or more mobile units (not shown) could be mounted on a rotating or rotatable arm or arms whereby the arm or arms are rotated once according to the calibration process described above and then fixed in place. In use, such a mobile unit assembly would function the same as the two or three static mobile unit assembly described above, but would have many of the setup and calibration advantages described previously. Notably, the rotation could be performed manually, and would not even necessarily require actual rotational movement so long as the mobile units may be placed in rotational positions relative to each other and to the assembly.

In accordance with another preferred embodiment of the present invention, the mobile unit assembly 101, or alternatively the two or three static mobile units, could be used to determine the location of any point on the paving apparatus 110 by developing geometric offset data relating each point to the mobile unit assembly. Significantly, the points selected could be the locations where the string line sensors, such as the steer and grade sensors 42,46,48, would otherwise have been placed. Thus, a mobile unit assembly of the present invention could be used to generate data equivalent to that which would have been developed by those sensors. In other words, the same positioning errors that would have been identified by the string line sensors can instead be identified using a mobile unit assembly of the present invention, and equivalent output data may be generated. Because that data could be provided as an input to a conventional control system, existing machine controls could be used, thereby avoiding considerable experimentation.

Figure 12:
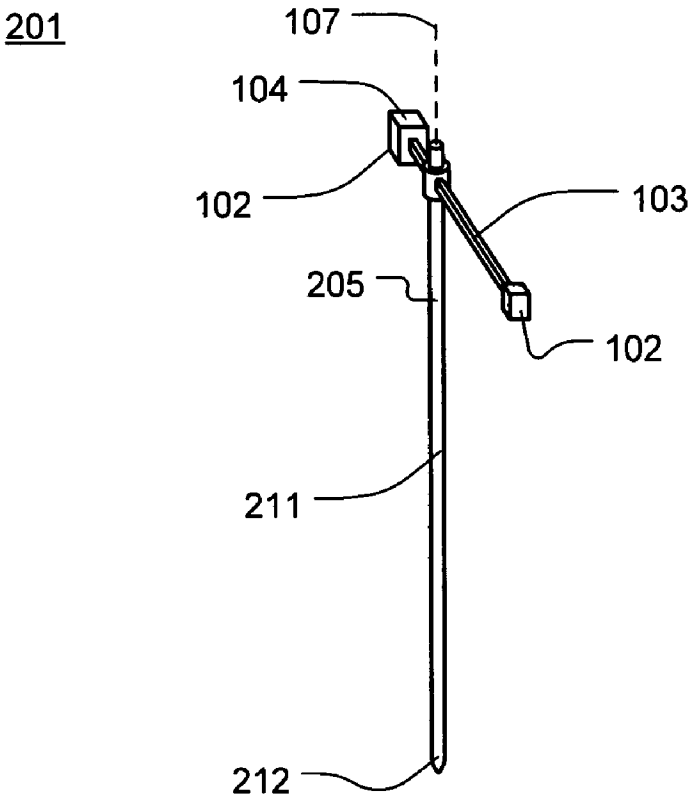
FIG. 12 is a perspective view of a handheld rotating mobile unit assembly in accordance with another preferred embodiment of the present invention.
Figure 13:
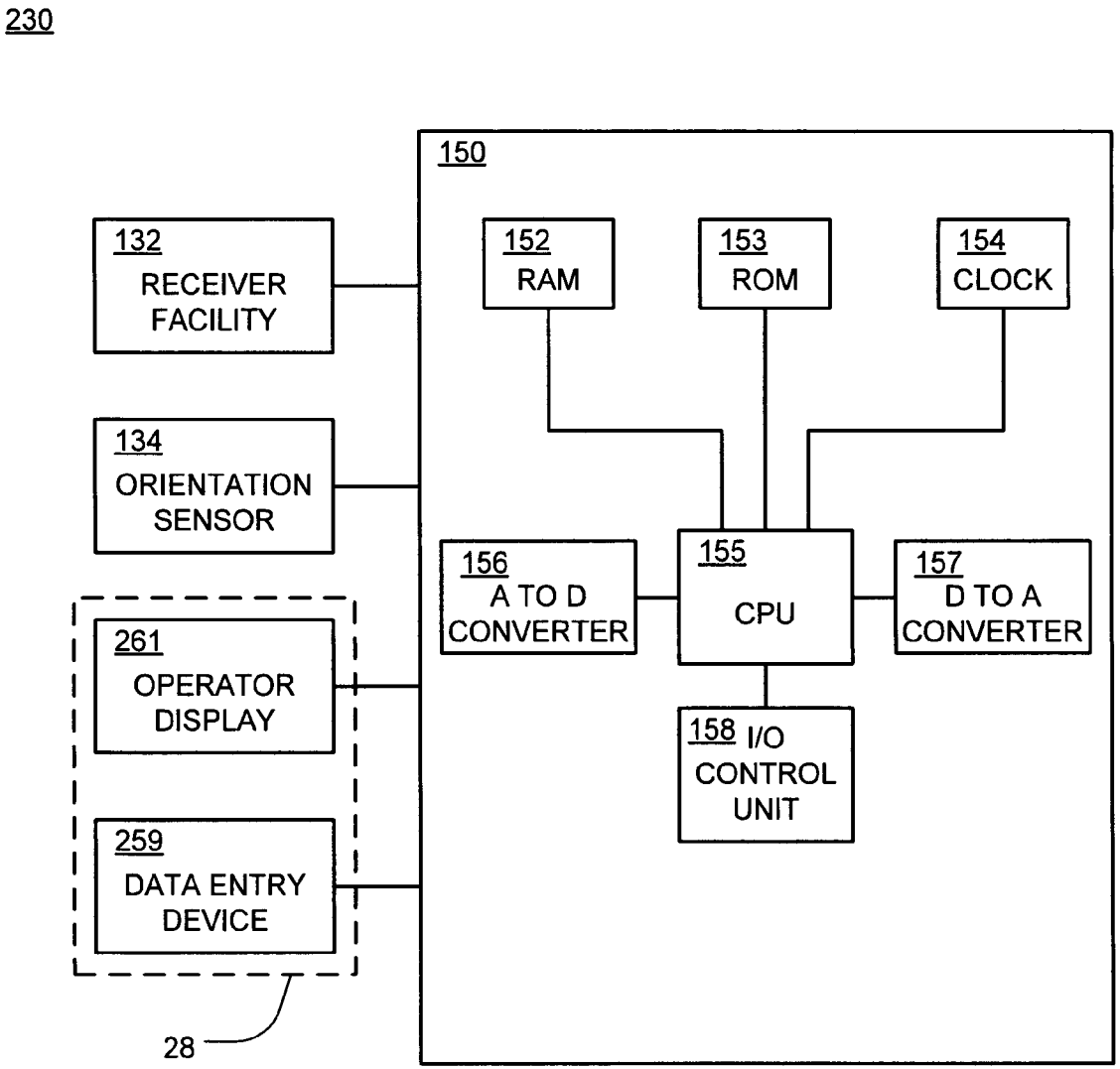
FIG. 13 is a block diagram illustrating some of the basic components of the mobile unit control system.

FIG. 12 is a perspective view of a handheld rotating mobile unit assembly 201 in accordance with another preferred embodiment of the present invention, and FIG. 13 is a block diagram illustrating some of the basic components of the mobile unit control system 230. Like the equipment-mounted rotating mobile unit assembly 101 of FIG. 6, the handheld rotating mobile unit assembly 201 includes a mobile unit 102, such as a "3D" optical prism or other device, mounted at the end of a support arm 103. Also like the equipment-mounted rotating mobile unit assembly 101, a counterweight 104 may be disposed at the other end of the support arm 103, and the entire arrangement is supported on a spindle 205 such that the prism 102 rotates about an axis 107 defined by the spindle 205. The length of the support arm 103 is not critical so long as the prism 102 is offset from the axis 107 around which it rotates by a sufficient distance to provide accurate readings, as described below. In particular, the radius of revolution can be small. As with the mounted mobile unit assembly 101, a larger radius will provide more accurate results, but because of the accuracy of robotic station measurements, even a 3-inch radius could provide accurate data. Unlike the spindle 105 of the equipment-mounted rotating mobile unit assembly 101 of FIG. 6, the spindle 205 of the handheld rotating mobile unit assembly 201 is mounted to, or part of, a long shaft 211, such as a surveying pole, whose distal end 212 is adapted to rest solidly at a identifiable point on the ground 12, building structure, surveying stake, or other relevant measurable point. The length of the shaft 211 makes it possible for the distal end 212 to rest on the ground while the mobile unit assembly 201 is disposed in a location that minimizes line-of-sight obstructions between the prism 102 and the robotic station 120, such as construction equipment, site features, or the like.

The handheld rotating mobile unit assembly 201 is similar to the equipment-mounted rotating mobile unit assembly 101 of FIG. 6 in several other respects. The mobile unit assembly 101 further includes a gear motor (not shown) for causing rotation of the support arm 103 around the axis 107. The support arm 103 may be directly or indirectly mounted to the motor. The handheld mobile unit assembly 201 also preferably includes a sensor 134, shown schematically in FIG. 13, for determining angular orientation of the support arm 103, and hence the prism 102, about the axis 107 at any given moment. The sensor 134 is preferably a rotary encoder mounted to the rotating support arm 103, but other types of sensors may be substituted. If a rotary encoder is utilized, a relative position encoder with a single index output is sufficient. The importance of the angular orientation information was made clear hereinabove. The prism 102, which may be of conventional design, is continuously rotated about the axis 107 defined by the spindle 105 in similar fashion to that shown in FIG. 8A. As shown therein, the rotation of the prism 102 occurs in a plane 108 defined as perpendicular to the axis 107. The robotic station 120 continues to track the prism 102 during its rotation. During each revolution of the prism 102 about the axis 107, the robotic station 120 gathers data on the position of the prism 102 at least twice and more preferably about three times. This process of gathering this data occurs generally conventionally, in that the robotic station controller 124 uses the robotic controls 122 to direct a laser 121 at the prism 102 to determine the distance and angle from the robotic station 120 to the prism 102, and uses the transmission facilities 123 to transmit that positional data as well as GPS data from the GPS system 125, to the paving apparatus control system 130. The orientation information determined by the sensor 134 is coordinated with the data from the robotic station 120 as described previously.

In use, rotation of the prism 102 is initiated and the handheld mobile unit assembly 201 is maneuvered to a desired location. The location may be a particular construction feature (such as a stake 18 for a string line 16) whose exact position is to be determined, or the location may be an exact physical location corresponding to a set of coordinates stored in the mobile unit control system 230. The exact location of the handheld mobile unit assembly 201 may be determined by positioning the distal end of the shaft 211 on the ground 12 and holding the shaft 211 steady while the prism 102 rotates and the robotic station 120 operates as described previously to determine position data and forward it to the control system 230. Notably, because the rotation of the prism 102 defines a plane 108, as illustrated in FIG. 8A, and because the distal end 212 of the shaft 211 is fixed relative to the center of the prism's rotation in that plane 108, the exact position of the shaft's distal end 212 may be derived. Furthermore, it is not necessary to hold the shaft 211 in a vertical orientation as long as the assembly 201 is held steady for at least one rotation of the prism 102. In this regard, it will be particularly appreciated that no particular operator skill is involved in using the assembly 201.

If desired, the mobile unit assembly 201 may then be repositioned as desired. In many respects, the use of the mobile unit assembly 201 is otherwise similar to other handheld locator devices, including one or more embodiments disclosed in co-pending and commonly-owned U.S. Patent Applications Nos. 60/910,243 and 60/910,247, the entirety of each of which is incorporated herein by reference.

Based on the foregoing information, it is readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

What is claimed is:

1. A 3D controlled paving apparatus, including:
a slip form paving machine;
a location-determination device supported by the slip form paving machine and arranged to rotate around an axis in a generally horizontal plane, the location-determination device adapted to operate in conjunction with a fixed base station to determine geodetic information about the slip form paving machine at least twice during each revolution of the device around the axis; and
a machine controller adapted to control one or more 3D operational functions of the slip form paving machine based on the geodetic information.

2. The 3D controlled paving apparatus of claim 1, wherein the location-determination device is a prism adapted to be tracked by the fixed base station using laser technology.

3. The 3D controlled paving apparatus of claim 1, wherein the location-determination device is a GPS device.

4. The 3D controlled paving apparatus of claim 1, wherein the machine controller is adapted to steer the slip-form paving machine based on the geodetic information.

5. The 3D controlled paving apparatus of claim 1, wherein the machine controller is adapted to adjust the cross slope of the slip-form paving machine based on the geodetic information.

6. The 3D controlled paving apparatus of claim 1, wherein the machine controller is adapted to adjust the long slope of the slip-form paving machine based on the geodetic information.

7. The 3D controlled paving apparatus of claim 1, wherein the machine controller is adapted to determine a velocity of the slip-form paving machine based on the geodetic information.

8. The 3D controlled paving apparatus of claim 1, wherein the machine controller is adapted to determine a traveled distance of the slip-form paving machine based on the geodetic information.

9. The 3D controlled paving apparatus of claim 1, wherein the instantaneous angular orientation of the location-determination device about the axis is determined each time the geodetic information is determined.

10. The 3D controlled paving apparatus of claim 1, wherein the location-determination device is adapted to operate in conjunction with a fixed base station to determine geodetic information about the slip form paving machine at least three times during each revolution of the device around the axis.

11. The 3D controlled paving apparatus of claim 10, wherein the location-determination device is adapted to operate in conjunction with a fixed base station to determine geodetic information about the slip form paving machine exactly three times during each revolution of the device around the axis.

12. The 3D controlled paving apparatus of claim 10, wherein the geodetic information includes identification of a particular point in three-dimensional space, and wherein the machine controller is adapted to triangulate the at least three points identified during each revolution of the device around the axis in order to determine a plane in three-dimensional space in which the location-determination device is rotating.

13. A 3D controlled paving apparatus, including:

a slip form paving machine;

a location-determination device supported by the slip form paving machine and arranged to rotate around an axis in a generally horizontal plane, the location-determination device adapted to operate in conjunction with a fixed base station to determine geodetic information about the slip form paving machine; and a machine controller adapted, based on the geodetic information, to steer the slip-form paving machine, adjust the cross slope of the slip-form paving machine based on the geodetic information, and adjust the long slope of the slip-form paving machine based on the geodetic information.

14. The 3D controlled paving apparatus of claim 13, wherein the location-determination device is a prism adapted to be tracked by the fixed base station using laser technology.

15. The 3D controlled paving apparatus of claim 13, wherein the location-determination device is a GPS device.

16. The 3D controlled paving apparatus of claim 13, wherein the machine controller is further adapted to determine a velocity of the slip-form paving machine based on the geodetic information.

17. The 3D controlled paving apparatus of claim 13, wherein the machine controller is further adapted to determine a traveled distance of the slip-form paving machine based on the geodetic information.

* * * * *